US011592228B2

(12) United States Patent
Park et al.

(10) Patent No.: US 11,592,228 B2
(45) Date of Patent: Feb. 28, 2023

(54) REFRIGERATOR

(71) Applicant: LG ELECTRONICS INC., Seoul (KR)

(72) Inventors: Jeongwon Park, Seoul (KR); Giseok Seong, Seoul (KR); Myungjin Chung, Seoul (KR); Kyungseok Kim, Seoul (KR); Jinho Kim, Seoul (KR); Yonghun Suh, Seoul (KR); Tackwon Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 277 days.

(21) Appl. No.: 16/725,551

(22) Filed: Dec. 23, 2019

(65) Prior Publication Data

US 2020/0224953 A1 Jul. 16, 2020

(30) Foreign Application Priority Data

Jan. 10, 2019 (KR) ..... 10-2019-0003592

(51) Int. Cl.

| | |
|---|---|
| ***F25D 17/06*** | (2006.01) |
| ***F25D 11/02*** | (2006.01) |
| ***F25D 17/04*** | (2006.01) |
| *F25D 29/00* | (2006.01) |

(52) U.S. Cl.

CPC ..... *F25D 17/06* (2013.01); *F25D 11/02* (2013.01); *F25D 17/042* (2013.01); *F25D 29/00* (2013.01); *F25D 2400/02* (2013.01); *F25D 2600/02* (2013.01); *F25D 2700/121* (2013.01)

(58) Field of Classification Search

CPC ..... F25D 2400/02

See application file for complete search history.

(56) References Cited

U.S. PATENT DOCUMENTS

| | | | |
|---|---|---|---|
| 5,031,413 | A | 7/1991 | Tsuihiji et al. |
| 5,228,499 | A | 7/1993 | Yoon |
| 5,758,512 | A | 6/1998 | Peterson et al. |
| 5,878,592 | A | 3/1999 | Borges et al. |
| 6,000,232 | A | 12/1999 | Witten-Hannah et al. |
| 6,058,723 | A | 5/2000 | Kusunoki et al. |
| 6,327,867 | B1 | 12/2001 | Hyodo et al. |

(Continued)

FOREIGN PATENT DOCUMENTS

| | | |
|---|---|---|
| CN | 1061845 | 6/1992 |
| CN | 1247968 | 3/2000 |

(Continued)

OTHER PUBLICATIONS

European Search Report dated May 26, 2020 issued in EP Application No. 20150246.5.

(Continued)

*Primary Examiner* — Filip Zec

(74) *Attorney, Agent, or Firm* — Ked & Associates, LLP

(57) ABSTRACT

A refrigerator includes a cabinet configured to have an inner case in which a storage chamber is formed, a cooler configured to cool the storage chamber, a heating device configured to be spaced apart from the cooler and heat the storage chamber, a circulation fan configured to circulate air in the storage chamber, and a controller configured to operate the circulation fan when the heating device is operated.

20 Claims, 18 Drawing Sheets

(56) References Cited

U.S. PATENT DOCUMENTS

| | | | | |
|---|---|---|---|---|
| 6,694,753 | B1 | 2/2004 | Lanz et al. | |
| 7,971,443 | B2 * | 7/2011 | Nishita | F25D 23/12 62/159 |
| 8,826,679 | B2 * | 9/2014 | May | F25D 29/00 62/126 |
| 9,140,479 | B2 | 9/2015 | Gomes et al. | |
| 9,599,353 | B2 | 3/2017 | Cur et al. | |
| 10,126,040 | B1 | 11/2018 | Ribeiro et al. | |
| 10,228,180 | B2 | 3/2019 | Oyu | |
| 10,655,893 | B2 | 5/2020 | Saint Pierre et al. | |
| 10,677,510 | B2 | 6/2020 | Kim | |
| 10,712,074 | B2 | 7/2020 | Scalf et al. | |
| 10,823,481 | B2 | 11/2020 | Gomes et al. | |
| 2003/0029178 | A1 | 2/2003 | Zentner et al. | |
| 2004/0263038 | A1 | 12/2004 | Ribolzi | |
| 2007/0000271 | A1 | 1/2007 | Lee et al. | |
| 2007/0033956 | A1 | 2/2007 | Kang et al. | |
| 2007/0074528 | A1 | 4/2007 | Rodriguez | |
| 2008/0000256 | A1 | 1/2008 | Shin | |
| 2008/0016889 | A1 | 1/2008 | Jung | |
| 2008/0148748 | A1 | 6/2008 | Viegas et al. | |
| 2008/0148761 | A1 | 6/2008 | Venkatakrishnan | |
| 2008/0196427 | A1 | 8/2008 | Bianchi et al. | |
| 2009/0015123 | A1 | 1/2009 | Lee | |
| 2009/0188262 | A1 * | 7/2009 | Schmid | F25D 17/065 62/56 |
| 2009/0193826 | A1 | 8/2009 | Yasugi et al. | |
| 2010/0070083 | A1 | 3/2010 | Kim et al. | |
| 2010/0199709 | A1 | 8/2010 | Holland | |
| 2011/0225994 | A1 | 9/2011 | Fotiadis et al. | |
| 2012/0036882 | A1 | 2/2012 | Park et al. | |
| 2012/0204581 | A1 | 8/2012 | Kang et al. | |
| 2013/0000333 | A1 | 1/2013 | Kim et al. | |
| 2013/0174586 | A1 | 7/2013 | Kang et al. | |
| 2014/0208783 | A1 | 7/2014 | Lee et al. | |
| 2015/0000310 | A1 | 1/2015 | Lee et al. | |
| 2015/0121918 | A1 | 5/2015 | Lee | |
| 2015/0354860 | A1 | 12/2015 | Kacmaz | |
| 2016/0153693 | A1 | 6/2016 | Oyu et al. | |
| 2016/0273823 | A1 | 9/2016 | Cho et al. | |
| 2017/0016271 | A1 | 1/2017 | Boucher | |
| 2017/0074568 | A1 * | 3/2017 | Orozco | F25D 17/06 |
| 2017/0188721 | A1 | 7/2017 | Park et al. | |
| 2017/0219254 | A1 | 8/2017 | Sul et al. | |
| 2018/0038626 | A1 | 2/2018 | Kim et al. | |
| 2018/0087814 | A1 | 3/2018 | Han et al. | |
| 2018/0163748 | A1 | 6/2018 | Hayamitsu et al. | |
| 2018/0299182 | A1 | 10/2018 | Besore et al. | |
| 2018/0363974 | A1 | 12/2018 | Costa et al. | |
| 2021/0010738 | A1 * | 1/2021 | Choi | F25D 21/006 |
| 2021/0055034 | A1 * | 2/2021 | Choi | F25D 21/006 |
| 2021/0285714 | A1 | 9/2021 | Heo et al. | |

FOREIGN PATENT DOCUMENTS

| | | |
|---|---|---|
| CN | 1367364 | 9/2002 |
| CN | 101048633 | 10/2007 |
| CN | 102121779 | 7/2011 |
| CN | 103968633 | 8/2014 |
| CN | 103033013 | 4/2015 |
| CN | 105164478 | 12/2015 |
| CN | 105890268 | 8/2016 |
| CN | 108302874 | 7/2018 |
| CN | 108369052 | 8/2018 |
| DE | 698 31 028 | 5/2006 |
| DE | 10 2008 054 934 | 7/2010 |
| EP | 1 806 553 | 7/2007 |
| EP | 2 078 908 | 7/2009 |
| EP | 3 190 364 | 7/2017 |
| EP | 3 301 385 | 4/2018 |
| EP | 3 338 041 | 6/2018 |
| JP | H10-300316 | 11/1998 |
| JP | H10-332239 | 12/1998 |
| JP | 2000-105048 | 4/2000 |
| JP | 2000-258028 | 9/2000 |
| JP | 2002-039663 | 2/2002 |
| JP | 2002-130908 | 5/2002 |
| JP | 2002-206840 | 7/2002 |
| JP | 2003-139454 | 5/2003 |
| JP | 2003-322454 | 11/2003 |
| JP | 2006-242463 | 9/2006 |
| JP | 2009-041883 | 2/2009 |
| JP | 2009-229018 | 10/2009 |
| JP | 2010-071606 | 4/2010 |
| JP | 2012-242074 | 12/2012 |
| KR | 20-0380906 | 4/2005 |
| KR | 10-2008-0003654 | 1/2008 |
| KR | 10-2011-0020482 | 3/2011 |
| KR | 10-2011-0027562 | 3/2011 |
| KR | 10-2018-0084516 | 7/2018 |
| WO | WO 2005/052474 | 6/2005 |
| WO | WO 2008/120862 | 10/2008 |
| WO | WO 2016/175562 | 11/2016 |
| WO | WO 2017/152580 | 9/2017 |

OTHER PUBLICATIONS

European Search Report dated May 26, 2020 issued in EP Application No. 20150251.5.

European Search Report dated May 26, 2020 issued in EP Application No. 20150252.3.

European Search Report dated Jun. 19, 2020 issued in EP Application No. 20150256.4.

U.S. Office Action dated Aug. 31, 2021 issued in U.S. Appl. No. 16/725,318.

Eccentrically, Merriam-Webster, https://www.merriam-webster.com/dictionary/eccentrically (Year: 2021).

What's the Difference Between a Gasket and a Seal, Aero Rubber Co., https://aerorubber.com/2020/05/28/whats-the-difference-between-a-gasket-and-a-seal/ (Year: 2021).

United States Office Action dated Feb. 15, 2022 issued in co-pending related U.S. Appl. No. 16/725,318.

Damper Definition & Meaning—Merriam-Webster, 2022 (Year: 2022).

United States Office Action dated Oct. 6, 2021 issued in co-pending related U.S. Appl. No. 16/725,166.

Chinese Office Action dated Apr. 26, 2021 issued in CN Application No. 202010017928.6.

United States Office Action dated Jul. 15, 2021 issued in U.S. Appl. No. 16/725,071.

Wine Guardian®—wine cooling, split system, and calculator (2021) (Year: 2021).

U.S. Office Action dated Oct. 1, 2021 issued in U.S. Appl. No. 16/725,428.

U.S. Office Action dated Sep. 17, 2021 issued in U.S. Appl. No. 16/725,436.

United States Office Action dated Jul. 26, 2021 issued in co-pending related U.S. Appl. No. 16/725,092.

Chinese Office Action dated Jul. 1, 2021 issued in Application No. 201911395312.6.

European Search Report dated May 25, 2020 issued in EP Application No. 20150244.0.

European Search Report dated May 25, 2020 issued in EP Application No. 20150245.7.

European Search Report dated May 25, 2020 issued in EP Application No. 20150248.1.

Chinese Office Action dated May 28, 2021 issued in CN Application No. 202010018245.2.

Refrigerant Pump-Down Method, HVAC Refrigeration, High Performance HVAC, Oct. 2016 (Oct. 18, 2021).

United States Office Action dated Dec. 17, 2021 issued in co-pending related U.S. Appl. No. 16/725,071.

U.S. Appl. No. 16/725,166, filed Dec. 23, 2019.

U.S. Appl. No. 16/725,071, filed Dec. 23, 2019.

Chinese Office Action dated Apr. 26, 2021 issued in CN Application No. 201911393284.4.

United States Office Action dated Sep. 28, 2022 issued in co-pending related U.S. Appl. No. 16/725,318.

(56) References Cited

OTHER PUBLICATIONS

United States Office Action dated Apr. 11, 2022 issued in co-pending related U.S. Appl. No. 16/725,271.
United States Notice of Allowance dated Mar. 23, 2022 issued in co-pending related U.S. Appl. No. 16/725,166.
United States Office Action dated Mar. 24, 2022 issued in co-pending related U.S. Appl. No. 16/725,428.
United States Notice of Allowance dated Jun. 23, 2022 issued in co-pending related U.S. Appl. No. 16/725,071.
United States Office Action dated Aug. 1, 2022 issued in co-pending related U.S. Appl. No. 16/725,271.
United States Office Action dated Nov. 18, 2022 issued in co-pending related U.S. Appl. No. 16/725,436.
European Office Action dated Sep. 27, 2022 issued in EP Application No. 20150251.5.
European Office Action dated Sep. 27, 2022 issued in EP Application No. 20150252.3.
U.S. Appl. No. 16/725,551, filed Dec. 23, 2019.
U.S. Appl. No. 16/725,428, filed Dec. 23, 2019.
U.S. Appl. No. 16/725,436, filed Dec. 23, 2019.
U.S. Appl. No. 16/725,092, filed Dec. 23, 2019.
U.S. Appl. No. 16/725,271, filed Dec. 23, 2019.
U.S. Appl. No. 16/725,318, filed Dec. 23, 2019.
U.S. Office Action dated Jan. 10, 2023 issued in U.S. Appl. No. 16/725,428.
Quest Climate-Humidity Control in Freezers, https://www.questclimate.com/humidity-control-freezers/, 2021 (Year: 2021).

* cited by examiner

REFRIGERATOR

CROSS-REFERENCE TO RELATED APPLICATION(S)

This application claims priority to and the benefit of Korean Patent Application No. 10-2019-0003592, filed on Jan. 10, 2019, the contents of which are hereby incorporated by reference in their entirety.

BACKGROUND

1. Field

The present disclosure relates to a refrigerator.

2. Background

In general, a refrigerator is an appliance that allows food or other items to be stored at a relatively low temperature in an internal storage space that is accessed by a door.

BRIEF DESCRIPTION OF THE DRAWINGS

Embodiments will be described in detail with reference to the following drawings in which like reference numerals refer to like elements, and wherein.

DETAILED DESCRIPTION

Figure 1:
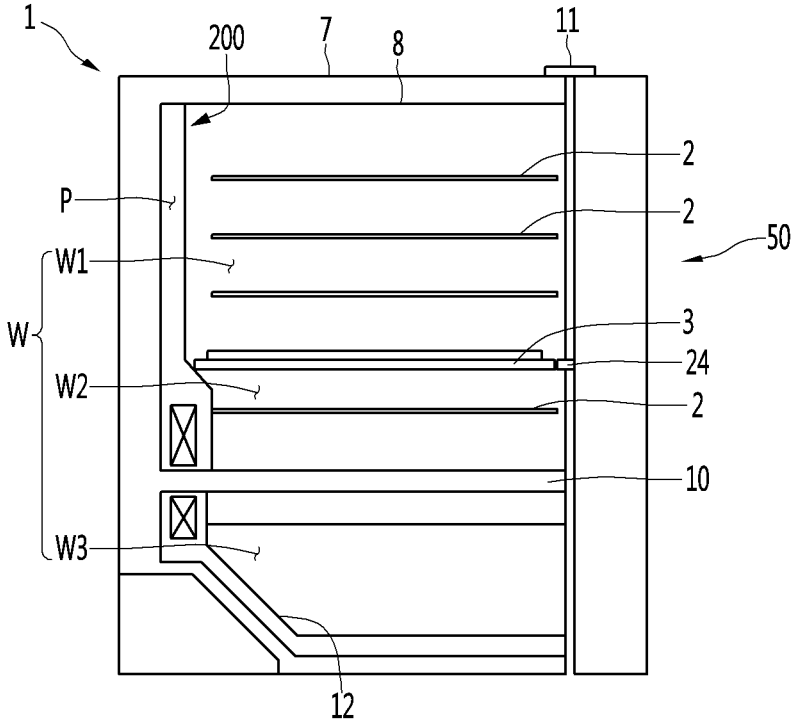
FIG. 1 is a sectional view illustrating an example of a refrigerator according to an embodiment of the present disclosure.

Hereinafter, specific embodiments of the present disclosure will be described in detail with reference to the accompanying drawings. For example, FIG. 1 is a sectional view illustrating an example of a refrigerator according to an embodiment of the present disclosure.

The refrigerator may have a storage chamber W in which goods and the like may be stored. The refrigerator may include a cabinet 1 in which a storage chamber W is formed. The refrigerator may further include a door 50 that opens and closes the storage chamber W. The door 50 may include at least one of a rotatable door 5 (e.g., a swinging door) or an advancing and retracting type door 6 (e.g., a drawer). The cabinet 1 may include an outer case 7 forming an outer appearance and an inner case 8 forming at least one surface for forming the storage chamber W therein.

The storage chamber W may be a storage chamber to receive mainly certain kinds of goods which are preferably stored at a specific temperature range. For example, the storage chamber W may be a dedicated storage chamber for storing certain goods that need to be kept warm or cold, for example, alcoholic liquors such as wine and beer, fermented foods, cosmetics, or medical supplies. As one example, the storage chamber for receiving wine may be maintained at a temperature range of 3° C. to 20° C., and this temperature range is relatively higher than temperatures for the refrigerating chamber of a conventional refrigerator to receive food items, and is preferable not to exceed 20° C. More specifically, the temperature of the storage chamber for red wine can be adjusted to 12° C. to 18° C., and the temperature of the storage chamber for white wine can be adjusted to 6° C. to 11° C. In another example, the temperature of the storage chamber for champagne can be adjusted to about 5° C.

The temperature of the storage chamber W can be adjusted such that the storage chamber temperature fluctuates between a target temperature upper limit value and a target temperature lower limit value of the storage chamber W. The quality or freshness of the goods stored in the storage chamber W may be reduced by the difference between the target temperature upper limit value and the target temperature lower limit value (hereinafter, referred to as storage chamber temperature difference). The refrigerator may be manufactured with a small storage chamber temperature difference according to the type of the goods and may minimize the reduction of the quality of the goods. The storage chamber W of the refrigerator of the present embodiment may be a storage chamber having a smaller storage chamber temperature difference than that of a general refrigerator. For example, the storage chamber temperature difference of the storage chamber W may be less than 3° C. and may be 2° C., as an example. Of course, in a case of considering certain types of goods that are very sensitive to temperature changes, the storage chamber temperature difference may be less than 1° C.

The refrigerator may include a device capable of adjusting the temperature of the storage chamber W (hereinafter, referred to as a "temperature adjusting device" or "temperature adjusting module"). The temperature adjusting device may include at least one of a cooling device or a heating device. The temperature adjusting device may cool or heat the storage chamber W by at least one of conduction, convection, and radiation. For example, a cooling device, such as an evaporator 150 or a heat absorbing body of a thermoelectric element, may be attached to the inner case 8 to cool the storage chamber W by conduction. By adding an airflow forming mechanism such as a fan, the air may be heat-exchanged with the cooling device by convection and supplied to the storage chamber W. In another example, a heating device, such as a heater or a heat generating body of the thermoelectric element, may be attached to the inner case 8 to heat the storage chamber W by conduction. An airflow forming mechanism, such as a fan, can supply a flow of air that is heated by convection and provided to the storage chamber W by convection.

In the present specification, the cooling device may be defined as a device capable of cooling the storage chamber W, including at least one of the evaporator 150, the heat absorbing body of the thermoelectric element, or the fan. In addition, the heating device may be defined as a device capable of heating the storage chamber W, including at least one of a heater, a heat generating body of the thermoelectric element, or a fan.

The refrigerator may further include an inner guide 200. The inner guide 200 may partition an inner portion of the inner case 8 into a first space in which goods are stored and a second space in which a temperature adjusting device is located (the second space hereinafter being referred to as a "temperature adjusting device chamber"). The temperature adjusting device chamber may include a cooling device chamber and a heating device chamber. For example, the temperature adjusting device chamber can be located between the inner guide 200 and the inner case 8, between the inner guide 200 and the outer case 7, or inside the inner guide 200, such as in the storage chamber W.

The inner guide 200 may be disposed to partition a cold air flow path P for supplying cold air to the space where goods are stored and the storage chamber W, and at least one cooling device may be disposed in the cold air flow path P. The inner guide 200 may be further disposed to partition a space in which goods are stored and a hot air flow path P for supplying heat to the storage chamber W, and at least one heating device may be disposed in the hot air flow path P. The inner guide for the cooling device and the inner guide for the heating device may be designed in common or may be manufactured separately. The inner guide 200 may form a storage space together with the inner case 8. The inner guide 200 may be disposed in front of the rear body of the inner case.

The refrigerator may have one space having the same storage chamber temperature range of the storage chamber W or may have two or more spaces having different storage temperature ranges from each other (such as freezer/refrigerator combination. The refrigerator may further include a partition member 3 disposed vertically or horizontally in order to divide the storage chambers W into two or more spaces (for example, a first space W1 and a second space W2) which have different storage chamber temperatures range from each other.

The refrigerator may further include the partition member 10 disposed vertically or horizontally in order to divide the storage chambers W into two or more spaces (for example, a second space W2, a third space W3) which have different storage chamber temperatures range from each other. The partition member 10 may be separately manufactured and then mounted in the inner case 8. The partition member 10 may be manufactured as a heat insulating material disposed between the outer case 7 and the inner cases 8 and 9.

The two or more spaces may be different in size and locations. For example, the first space W1 may be located at the upper side, the second space W2 may be located at the lower side, and the partition member 3 may be disposed so that the size of the first space W1 is larger than the size of the second space W2. In one example, the first storage chamber temperature for the first space W may be higher than the second storage chamber temperature for the second space W2.

In the present specification, it can be defined that a meaning of the first storage chamber temperature being higher than the second storage chamber temperature corresponds to at least one case of a case where the maximum value of the first storage chamber temperature is greater than the maximum value of the second storage chamber temperature, a case where the average value of the first storage chamber temperature is greater than the average value of the second storage chamber temperature, a case where the minimum value of the first storage chamber temperature is greater than the minimum value of the second storage chamber temperature, or a case where a current detected value of the first storage chamber temperature is greater than a current detected value of the second storage chamber temperature.

The refrigerator may further include a door (hereinafter, a see-through door) through which the user can see the storage chamber through a see-through window without opening the door 50 from the outside of the refrigerator, and the see-through door will be described later. In addition, the refrigerator may further include a transparent gasket 24 disposed on at least one of the see-through door or the partition members 3 and 10. When the see-through door closes the storage chamber W, the transparent gasket 24 may combine with the partition members 3 and 10 to partition the storage chamber W into two or more spaces having different storage temperature ranges from each other together.

The refrigerator may further include door opening modules (or door motors) 11 and 11' for guiding an opening motion of the door 50. The door opening modules 11 and 11' may be a rotatable door opening module 11 which can allow the door 5 to be rotated more than a predetermined angle without the user holding the door 5, or an advancing and retracting type door opening module 11' which can allow the door (e.g., a drawer) 6 to be advanced and retracted in a front and rear direction. The door opening modules 11 and 11' will be described later.

The refrigerator may further include a lifting module (or lifting mechanism) 13 capable of lifting or lowering the holder (or bin) 12, and although not illustrated in FIG. 1, the lifting module may be located in at least one of the storage chamber or the door.

As previously described, the refrigerator may include a plurality of doors for opening and closing two or more spaces having different storage temperature ranges from each other. At least one of the plurality of doors may be a see-through door having a region that is formed of a transparent or translucent material, such as glass. At least one of the cabinet 1 or the plurality of doors may include door opening modules 11 and 11'. The lifting module 13 for lifting and lowering the holder located in the storage chamber to open and close may be disposed on at least one of the plurality of doors. For example, the door for the storage chamber located at the top may be a see-through door, and a lifting module 13 for lifting and lowering a holder 12 of a storage chamber located at the lower portion may be disposed.

Figure 2:
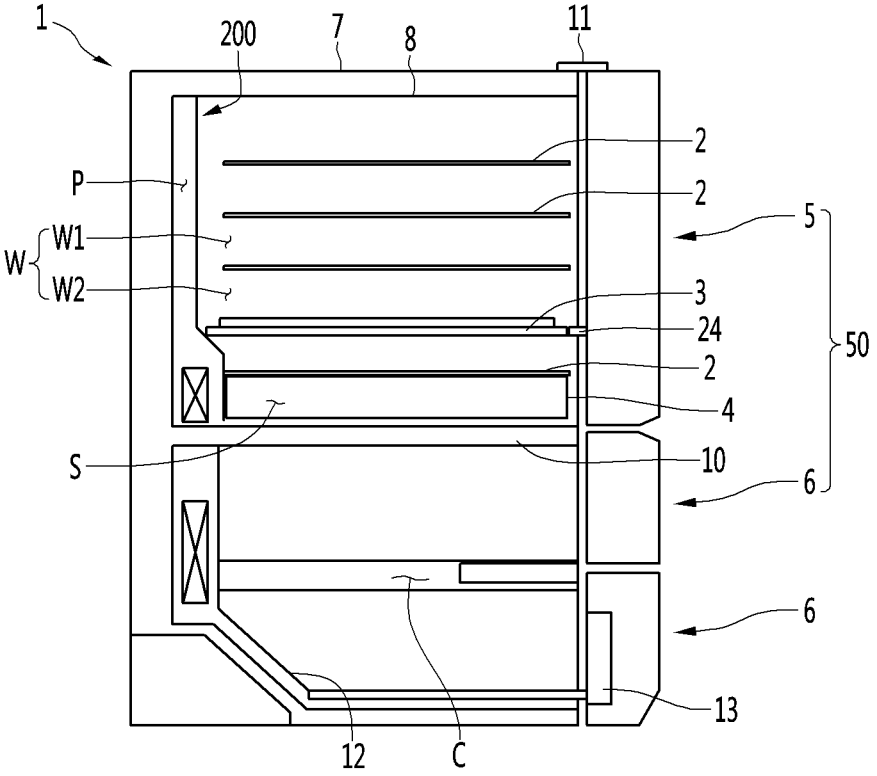
FIG. 2 is a sectional view illustrating another example of a refrigerator according to an embodiment of the present disclosure.

FIG. 2 is a sectional view illustrating an example of another type of refrigerator according to an embodiment of the present disclosure. Hereinafter, the storage chamber W illustrated in FIG. 1 will be described as a first storage chamber (or first refrigeration chamber) W. The refrigerator may further include at least one of the first storage chamber W (e.g., first chambers W1 and W2) and at least one second storage chamber (or second refrigeration chamber) C that may be temperature-controlled independently of the first storage chamber W. Hereinafter, a detailed description of the same configuration and operation as those of the storage chamber W illustrated in FIG. 1 will be omitted for the first storage chamber W, and a different configuration and operation from the storage chamber W illustrated in FIG. 1 will be described.

The second storage chamber C may be a storage chamber having a temperature range lower than the temperature range of the first storage chamber W and, for example, may be a storage chamber having a temperature range of −24° C. to 7° C. The second storage chamber C may be a storage chamber which is temperature-controlled based on a target temperature, which is a temperature selected by a user in this lower temperature range (e.g., between −24° C. to 7° C.). The second storage chamber C may be composed of a switching chamber (or a temperature changing chamber) in which any one of a plurality of temperature ranges may be selected, or may be configured as a non-switching chamber having one temperature range.

The switching chamber is a storage chamber which can be temperature-controlled to a selected temperature range among a plurality of temperature ranges, and the plurality of temperature ranges may include, for example, a first temperature range above zero, a second temperature range below zero, and a third temperature range between the first temperature range and the second temperature range. For example, the user may provide an input to control the second storage chamber C to operate in a mode (for example, a refrigerating chamber mode) associated with a temperature range above zero, and accordingly, the temperature range of the second storage chamber C may be selected a temperature range above zero (for example, 1° C. to 7° C.). For example, the user may further input a desired temperature in the temperature range above zero, and the target temperature of the second storage chamber C may be a specific temperature (for example, 4° C.) entered by a user in the temperature range (for example, 1° C. to 7° C.) above zero.

In another example, the user can provide an input to select an operating mode in which the second storage chamber C is maintained in the temperature range below zero (for example, freezing chamber mode) or a special mode (for example, a mode for maintaining an optimal temperature range for storing certain kind of goods, such as a kimchi storage mode). For example, the user may further input a desired temperature in the temperature range below zero or a desired temperature for the certain type of goods, and the second storage chamber C may be maintained within a temperature range that is centered at or otherwise includes the specific inputted temperature.

As previously described, the first storage chamber W may be a specific goods storage chamber in a specific temperature range or other environmental conditions (e.g., humidity, light levels, etc.) are maintained to optimally store a particular kind of goods or to mainly store a certain kind of goods, or the second storage chamber C may be a non-specific goods storage chamber in which a various kinds of goods may be stored in addition to a specific kind of goods. Examples of specific goods may include alcoholic beverages such as wine, fermented foods, cosmetics, and medical supplies. For example, the first storage chamber W may be a storage chamber in which wine is stored or a wine chamber in which wine is mainly stored, and the second storage chamber C may be a non-wine chamber in which goods other than wine are stored or goods other than wine are mainly stored.

A storage chamber having a relatively small storage chamber temperature difference among the first storage chamber W and the second storage chamber C may be defined as a constant temperature chamber, and a storage chamber having a relatively large storage chamber temperature difference among the first storage chamber W and the second storage chamber C may be defined as a non-constant temperature chamber.

Any one of the first storage chamber W and the second storage chamber C may be a priority storage chamber which is controlled in priority, and the other may be a subordinate storage chamber which is controlled in relatively subordinate. A first goods having a large or expensive quality change according to the temperature change may be stored in the priority storage chamber, and A second goods having a small or low quality change according to the temperature change may be stored in the subordinate storage chamber.

The refrigerator may perform a specific operation for the priority storage chamber and a specific operation for the subordinate storage chamber. The specific operation includes a general operation and a special operation for the storage chamber. A general operation may include, for example, a conventional cooling operation for the storage chamber cooling. The special operation may include, for example, a defrost operation for defrosting the cooling device, a door load response operation that can be performed when one or more predetermined conditions are satisfied after the door is opened, or an initial power supply operation, which is an operation when the power is first supplied to the refrigerator.

The refrigerator may be controlled such that a specific operation for the priority storage chamber is performed first when two operations collide with each other. Here, the collision of the two operations may be occur, for example, as a case where the start condition of the first operation and the start condition of the second operation are satisfied at the same time; as a case where the start condition of the first operation is satisfied and thus the start condition of the second operation is satisfied while the first operation is in progress; or as a case where the start condition of the second operation is satisfied and thus the start condition of the first operation is satisfied while the second operation is in progress.

For example, in the refrigerator, the priority storage chamber may be cooled or heated prior to the subordinate storage chamber when the temperature of the priority storage chamber is not satisfied and the temperature of the subordinate storage chamber is not satisfied. In another example, while the cooling device for cooling the subordinate storage chamber is being defrosted, if the temperature of the priority storage chamber is not satisfied, the priority storage chamber may be cooled or heated while the cooling device of the subordinate storage chamber is being defrosted (even if this cooling or heating of the priority chamber may interfere with defrosting the cooling device of the subordinate storage chamber).

In another example, if the temperature of the priority storage chamber is not satisfied (e.g., outside of a desired temperature range) while the subordinate storage chamber is in progress of the door load response operation, the priority storage chamber may be cooled or heated during the door load response operation of the subordinate storage chamber such that the temperature of the priority storage chamber is adjusted to be within the desired temperature range.

In certain configurations, any one of the first storage chamber W and the second storage chamber C may be a storage chamber in which the temperature is adjusted by the first cooling device and the heating device, and the other is a storage chamber in which the temperature is adjusted by a second cooling mechanism or device.

In the refrigerator, a separate receiving member (or storage drawer) 4 may be additionally disposed in at least one of the first space W1 or the second space W2. In the receiving member 4, a separate space S (hereinafter, referred to as a receiving space) may be formed separately from the first space W1 and the second space W2 to accommodate goods. The refrigerator may adjust the receiving space S of the receiving member 4 to a temperature range different from that of the first space W1 and the second space W2.

The receiving member 4 may be disposed to be located in the second space W2 provided below the first space W1. The receiving space S of the receiving member 4 may be smaller than the second space W2. In one example, the storage chamber temperature of the receiving space S may be equal to or less than the storage chamber temperature of the second space W2.

In the refrigerator, in order to dispose as many shelves 2 as possible in the first storage chamber W, the length of the refrigerator itself in the vertical direction may be longer than the width in the horizontal direction, and in this case, the length of the refrigerator in the vertical direction may be more than twice the width in the horizontal direction. Meanwhile, since the refrigerator may be unstable and tip over if the length in the vertical direction is too long relative to the width in the horizontal direction, it may be preferable that the length in the vertical direction is less than three times the width in the horizontal direction. Certain examples of the length in the vertical direction that can store a plurality of the specific goods may be 2.3 to 3 times the width in a left and right direction, and a particular example may be 2.4 to 3 times the width in the left and right direction.

Meanwhile, even if the length of the refrigerator in the vertical direction is longer than the width in the left and right direction, when the length of the storage chamber in which the specific goods are substantially stored (for example, the first storage chamber W) is relatively short in a vertical direction, the number of specific goods that may be received in the storage chamber may not be high. In the refrigerator, preferably, the length of the first storage chamber W in the vertical direction is longer than the length of the second storage chamber C in the vertical direction so that the specific goods can be stored as much as possible. For example, the length of the first storage chamber W in the vertical direction may be 1.1 times to 1.5 times the length of the second storage chamber C in the vertical direction.

As previously described, at least one of the first door 5 and the second door 6 may be a see-through door, and the see-through door will be described later. Additionally, the refrigerator may further include door opening modules 11 and 11' for guiding the opening of at least one of the first door 5 or the second door 6, and the door opening modules 11 and 11' will be described later. In at least one of the first storage chamber W, the second storage chamber C, the first door 5, or the second door 6, a lifting module 13 capable of lifting a holder 12 may be disposed, and the lifting module 13 will be described later.

Figure 3:
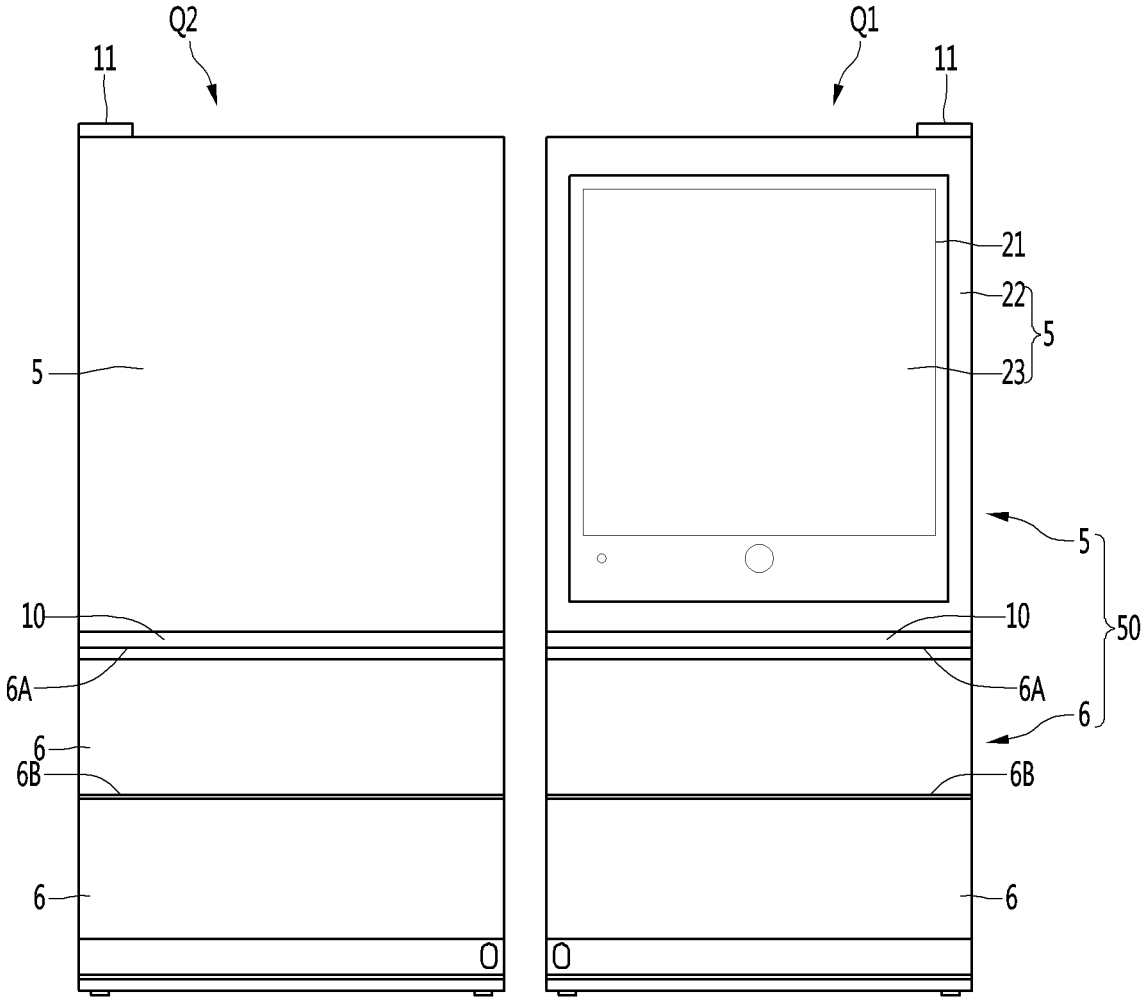
FIG. 3 is a front view when a refrigerator according to an embodiment of the present disclosure is disposed adjacent to another refrigerator.

FIG. 3 is a front view when a refrigerator according to an embodiment of the present disclosure is positioned adjacent to another refrigerator. The refrigerator described in the present disclosure may be disposed adjacent to one or more other refrigerators, and a pair of adjacent refrigerators may be disposed, for example, in the left and right direction. Hereinafter, for convenience of description, the first refrigerator Q1 and the second refrigerator Q2 will be referred for description thereof, and the same configuration of the first refrigerator Q1 and the second refrigerator Q2 as each other will be described using the same reference numerals for convenience of description. In one example, a refrigerator may include a plurality of storage chambers that may be located in the left and right direction and the vertical direction in one outer case, such as a side by side type refrigerator or a French door type refrigerator.

At least one of the first refrigerator Q1 and the second refrigerator Q2 may be a refrigerator to which an embodiment of the present disclosure is applied. Although the first refrigerator Q1 and the second refrigerator Q2 may have some functions that different from each other, the lengths (or heights) of the first and second refrigerators Q1 and Q2 in the vertical direction be the same or almost similar so that the overall appearance may give the same or similar feeling when disposed adjacent to each other in the left and right direction.

Each of the first refrigerator Q1 and the second refrigerator Q2 may include each of a first storage chamber and a second storage chamber, and the first storage chamber and the second storage chamber may include a partition member 10 partitioning in the vertical direction, respectively, and the partition member 10 of the first refrigerator Q1 and the partition member 10 of the second refrigerator Q2 may overlap in the horizontal direction.

The upper end 6A of the second door 6 opening and closing the second storage chamber of the first refrigerator Q1 and the upper end 6A of the second door 6 opening and closing the second storage chamber of the second refrigerator Q2 can coincide with each other in the horizontal direction. Similarly, the lower end 6B of the second door 6 opening and closing the second storage chamber of the first refrigerator Q1 and the lower end 6B of the second door 6 opening and closing the second storage chamber of the second refrigerator Q2 can coincide with each other in the horizontal direction.

Figure 4:
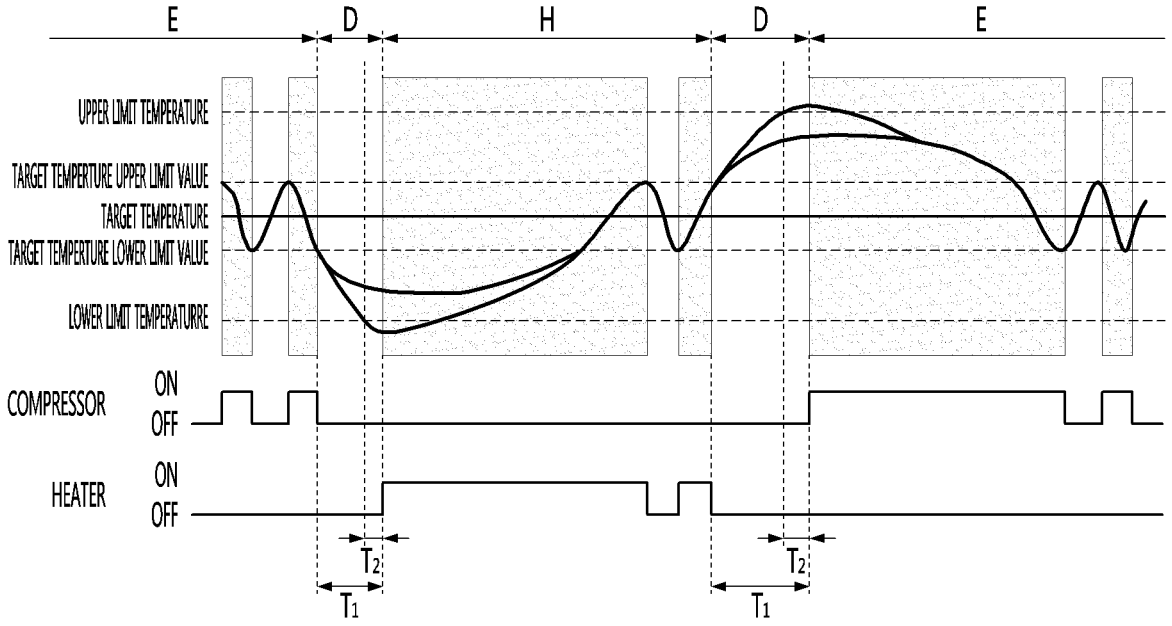
FIG. 4 is a view illustrating on and off of cooling device and on and off of heating device according to the temperature change of the storage chamber according to an embodiment of the present disclosure.

FIG. 4 is a view illustrating on and off of a cooling device and on and off of heating device according to the temperature change of the storage chamber according to an embodiment of the present disclosure. As previously described, the refrigerator may be provided with cooling device and heating device that can be independently controlled to control the temperature of the storage chamber W.

The refrigerator may include cooling device and heating device for controlling the temperature of at least one storage chamber among a specific goods storage chamber, a constant temperature chamber, and a priority storage chamber. The refrigerator may be controlled in a plurality of modes for temperature control of the storage chamber W, and as shown in FIG. 4, the plurality of modes may include a cooling mode E in which the storage chamber W is cooled by the cooling device, a heating mode H in which the storage chamber W is heated by the heating device, and a standby mode (D) which maintains the current state without cooling or heating the storage chamber W. The refrigerator may include a temperature sensor for sensing a temperature of the storage chamber W and may selectively perform the cooling mode E, the heating mode H, and the standby mode D according to the storage chamber temperature sensed by the temperature sensor.

The cooling mode E is not limited to the storage chamber W being continuously cooled by the cooling device, and may also include, for example, a case in which the storage chamber is generally cooled by the cooling device as a whole but the storage chamber W is temporarily not being cooled by the cooling device. The cooling mode E may also include a case in which the storage chamber W is cooled by the cooling device as a whole, and the storage chamber is also temporarily being heated by the heating device. The cooling mode E may also include a case where the time when the storage chamber is cooled by the cooling device is longer than the time when the storage chamber W is not cooled by the cooling device.

The cooling mode E may be a mode in which the cooling device is operated or stopped. For example, operation of the cooling device may include the cooling device being controlled such that at least a portion of the cooling device is at a temperature lower than the temperature of the storage chamber W. The operation of the cooling device may also include cool air being supplied to the storage space, may include driving a fan for supplying cold air to the storage space, and/or may include opening a damper for controlling air flowing to the storage space.

For example, when the cooling device is a refrigeration cycle including a compressor, a condenser, an expansion mechanism, and an evaporator, the operation of the cooling device may mean switching the refrigerant valve or driving the compressor to flow the refrigerant to the evaporator. An example of the operation (or activation) of the cooling device may be to turn on only the fan to use the latent heat remaining in the evaporator while the refrigerant does not flow to the evaporator, such that cooling may continue to occur even though a compressor is not be activated. Conversely, stopping the cooling device may mean that the fan is turned off while the refrigerant valve is switched or the compressor is turned off (i.e., the compressor is stopped) so that the refrigerant does not flow to the evaporator.

For example, the cooling mode E may be a mode in which the refrigerant passes through the evaporator, the air in the storage chamber W is cooled by the evaporator, and then flows into the storage chamber W. In the cooling mode E, the compressor may be turned on and off according to the temperature of the storage chamber W. In another example of the cooling mode E, the compressor may be turned on and off such that the storage chamber temperature is maintained between the target temperature lower limit value and the target temperature lower limit value. For example, the compressor may be turned on when the storage chamber temperature reaches the target upper limit value and may be turned off when the storage chamber temperature reaches the target temperature lower limit value.

As another example, when the cooling device is a heat absorbing body of the thermoelectric element, the operation (or activation) of the cooling device may mean that current is applied to the thermoelectric element so that the heat of the heat absorbing body of the thermoelectric element is transferred to the heat generating body of the thermoelectric element. An example of the operation of the cooling device may be that only the fan is turned on to use the latent heat remaining in the heat absorbing body of the thermoelectric element while the current is blocked in the thermoelectric element. The stopping of the cooling device may mean that the thermoelectric element and the fan are turned off (that is, blocking the current applied to the thermoelectric element and the fan).

In a case where the refrigerator includes an evaporator for cooling the first space W1, a fan for circulating air to the first space W1 and the evaporator, and a first damper for adjusting air blown into the first space W1, the operation (or activation) of the cooling device may mean that the compressor and the fan are driven and the first damper is controlled to be in the open mode. Similarly, in a case where the refrigerator include an evaporator for cooling the second space W2, a fan for circulating air to the second space W2 and the evaporator, and a second damper for adjusting the air blown into the second space W2, the operation (or activation) of the cooling device may mean that the compressor and the fan are driven, and the second damper is being controlled in the open mode. When the refrigerator further includes a refrigerant valve for supplying or blocking the refrigerant to the evaporator, the operation (or activation) of the cooling device may mean controlling the refrigerant valve to be in the evaporator supplying mode.

The heating mode H is not limited only to the storage chamber W being continuously heated by the heating device and may also include a case where the storage chamber W is heated by the heating device as a whole and the storage chamber W is temporarily not heated by the inactive heating device, and may also include a case where the storage chamber W is heated by the heating device as a whole, and the storage chamber W is also temporarily cooled by the cooling device. The heating mode H may include a case where the time for which the storage chamber W is heated by the heating device is longer than the time for which the storage chamber W is not heated by the heating device.

The heating mode H may be a mode in which the heating device is activated or stopped. Operation (e.g., activation) of the heating device may mean that the heating device is controlled such that at least a portion of the heating device is at a temperature higher than the temperature of the storage chamber W. For example, when the heating device is a heater such as a hot wire heater or a planar heater or a heat generating body of the thermoelectric element, the operation of the heating device may mean that the heating device is turned on (current is applied to the heating device). An example of the operation of the heating device may be that only the fan is turned on to use the latent heat remaining in the heating device while the current is blocked in the heating device. The stopping of the heating device may mean that the heating device is entirely turned off (e.g., blocking current applied to the heating device and the fan).

In the heating mode H, the heating device may be turned on and off so that the storage chamber temperature is maintained between the target temperature lower limit value and the target temperature upper limit value. For example, the heating device may be turned off when the storage chamber temperature reaches the target temperature upper limit value and may be turned on when the storage chamber temperature reaches the target temperature lower limit value.

When the refrigerator includes a heating device for heating the first space W1 and a fan (or HG fan) for circulating air to the first space W1 and the heating device, operation of the heating device may mean that the heating device is turned on (operated) and the fan (or HG fan) is driven. When the refrigerator includes an additional heating device for heating the second space W2 and a fan for circulating air to the second space W2 and the additional heating device, operation of the heating device may mean that the additional heating device is turned on (operated) and the fan is driven.

The standby mode D may be a mode in which each of the cooling device and the heating device is stopped. For example, the standby mode D may be a mode in which the refrigerant does not pass through the evaporator and the heater maintains in an off state. The standby mode D may be a mode in which the heater also maintains the off state while the compressor maintains the off state. The standby mode D may be a mode in which the air in the storage chamber (W) is not forced to flow by the fan.

In one example, the plurality of modes may be performed in the order of the cooling mode E, the standby mode D, and the heating mode H, over time. In another example, the plurality of modes may be performed in the order of the heating mode H, the standby mode D, and the cooling mode E, over time. In yet another example, the plurality of modes may be performed in the order of the cooling mode E, the standby mode D, and then the cooling mode E, over time. In still another example, the plurality of modes may be performed in the order of the heating mode H, the standby mode D, and the heating mode H, over time.

In the plurality of modes, when the cooling mode E and the standby mode D are alternately performed and the starting condition of the heating mode H is reached during the standby mode D, the standby mode D can be ended, and the heating mode H can start. In the plurality of modes, when the heating mode H and the standby mode D are alternately performed, and the cooling mode E is started during the standby mode D, the standby mode D can be ended, and the cooling mode (E) can start. In certain examples, the plurality of modes do not immediately switch to the heating mode H without the standby mode D during the cooling mode E, and do not immediately switch to the cooling mode E without the standby mode D during the heating mode H.

The refrigerator may include a controller 30 (see FIG. 9) such as a processor and/or processing circuitry for controlling various electronic devices such as a motor provided in the refrigerator. The controller 30 may control the cooling device and the heating device. The controller 30 can selectively perform a plurality of modes (E) (H) (D).

For example, the cooling mode E may be a mode in which the controller 30 controls the cooling device such that the storage chamber W maintains the target temperature range by the cooling device. The target temperature range may range from a lower limit value of the target temperature to an upper limit value of the target temperature. In the cooling mode E, the cooling device may be operated when the temperature of the storage chamber sensed by the temperature sensor (hereinafter, referred to as storage chamber temperature) is higher than the target temperature upper limit value, and may be stopped when the storage chamber temperature is lower than the target temperature lower limit value.

The heating mode H may be a mode in which the controller 30 controls the heating device such that the storage chamber W maintains the target temperature range by the heating device. For example, in the heating mode H, the heating device may be stopped if the storage chamber temperature is higher than the target temperature upper limit value, and may be operated if the storage chamber temperature is lower than the target temperature lower limit value.

During the operation of the refrigerator, the temperature of the storage chamber W may vary according to, for example, the load of the storage chamber W and the ambient temperature of the refrigerator, and the temperature of the storage chamber W may be outside the target temperature range. An example in which the temperature of the storage chamber W is outside the target temperature range may include a case where the storage chamber temperature is between the target temperature lower limit value and the lower limit temperature. Another example in which the temperature of the storage chamber W is outside the target temperature range may include a case where the storage chamber temperature is between the target temperature upper limit value and the upper limit temperature.

The lower limit temperature may be lower than the target temperature lower limit value. The lower limit temperature may be a temperature set lower by a set temperature (for example, 2° C.) than the target temperature lower limit value. When the target temperature and the target temperature lower limit value are changed, the lower limit temperature may also be changed according to the changed target temperature and target temperature lower limit value.

The upper limit temperature may be a temperature higher than the target temperature upper limit value. The upper limit temperature may be a temperature set higher by a set temperature (for example, 2° C.) than the target temperature upper limit value. When the target temperature and the target temperature upper limit value are changed, the upper limit temperature may also be changed according to the changed target temperature and target temperature upper limit value.

As described above, when the temperature of the storage chamber is between the target temperature lower limit value and the lower limit temperature, or between the target temperature upper limit value and the upper limit temperature, the refrigerator may be operated in a standby mode, and the controller 30 may stop each of the cooling device and the heating device. An example of the standby mode D may be a mode in a case where the storage chamber temperature is maintained between the target temperature lower limit value and the lower limit temperature, and the refrigerator does not immediately switch to the heating mode H during the cooling mode E and can be controlled in the order of the cooling mode E, the standby mode D, and the heating mode H. In this case, the refrigerator maintains the standby mode D after the cooling mode E ends, and when the heating mode H starts during the standby mode D, the refrigerator can be switched from the standby mode D to the heating mode H.

After the cooling mode E is ended, if the time in which the storage chamber temperature is between the target temperature lower limit value and the lower limit temperature is equal to or greater than a first set time T1 (for example, 100 minutes), the refrigerator may be switched from the standby mode D to the heating mode H. After the cooling mode E is ended, the condition that the time in which the storage chamber temperature is between the target temperature lower limit value and the lower limit temperature is equal to or greater than the first set time T1 (for example, 100 minutes) may be a first starting condition of the heating mode H.

The temperature of the storage chamber W, which has been temperature-adjusted in the cooling mode E, may be maintained below the target temperature lower limit value without rising again above the target temperature lower limit value for a long time while being lowered below the target temperature lower limit value. This may be a case where the standby mode D is maintained for a long time after the cooling mode E is ended and the refrigerator cannot be returned to the cooling mode E again.

In a case where the storage chamber W is continued in a state of being lower than the target temperature range for a long time without rising to the target temperature range, deterioration of the quality of the goods stored in the storage chamber W may occur, and, in this case, since the temperature of the storage chamber W cannot rise using the cooling device, the controller 30 may stop the standby mode D and start the heating mode H in order to increase the temperature of the storage chamber W by the heating device.

Meanwhile, after the cooling mode E is finished, if the time when the storage chamber temperature is lower than the lower limit temperature is equal to or greater than the second set time T2 (for example, 5 minutes), the refrigerator can be switched from the standby mode D to the heating mode H. The second set time (for example, 5 minutes) may be shorter than the first set time (for example, 100 minutes). After the cooling mode E is ended, the condition that the time in which the storage chamber temperature is lower than the lower limit temperature is equal to or greater than the second set time T2 (for example, 5 minutes) may be a second starting condition of the heating mode H.

If the temperature of the storage chamber W, which has been temperature-adjusted in the cooling mode E, reaches a lower limit temperature lower than the target temperature lower limit value, the temperature of the storage chamber W may be excessively cool and lower than the target temperature range. In this case, the controller 30 can stop the standby mode D and start the heating mode H in order to increase the temperature of the storage chamber W by operation of the heating device before the first set time (for example, 100 minutes) is reached.

After the cooling mode E is ended, the controller 30 may not wait for the second set time (for example, 5 minutes) if the storage chamber temperature is lower than the lower limit temperature, and then the controller 30 can immediately switch from the standby mode D to the heating mode H. However, the user can input a new, lower target temperature through the input device while the storage chamber temperature is lower than the lower limit temperature, and if the refrigerator is already switched to the heating mode (H), the controller 30 may not be able to respond quickly to a new target temperature input by the user.

As described above, in a case where the time in which the storage chamber temperature is lower than the lower limit temperature is equal to or greater than the second set time (for example, 5 minutes) after the cooling mode is ended, if the controller 30 is switched from the standby mode D to the heating mode H, although the user inputs a new target temperature to be lower than before through the input device, the controller 30 can change the lower limit temperature to be lower than before with reference to the new target temperature before reaching the second set time (for example, 5 minutes), and the controller 30 may determine that the heating mode H is switched based on the newly changed lower limit temperature. In this case, the refrigerator may be switched from the standby mode D to the cooling mode E according to the newly input target temperature, and the unnecessary heating mode H may be minimized. In other words, the refrigerator may respond more quickly to a change to lower the target temperature, as inputted by the user.

For convenience of explanation, a case where the target temperature is 16° C., the target temperature lower limit value is 15.5° C., the lower limit temperature is 13.5° C., the target temperature upper limit is 16.5° C., and the upper limit temperature is 18.5° C. will be described as an example. After the storage chamber temperature is lowered to 15.5° C. or less (e.g., in cooling mode E), the storage chamber temperature is not lowered to 13.5° C. or less and can be maintained for a long time between 15.5° C. and 13.5° C. (e.g., in standby mode D). The controller 30 can count the time for which the storage chamber temperature is maintained between 15.5° C. and 13.5° C., and if the counted time is equal to or greater than the first set time (for example, 100 minutes), the controller 30 can end the standby mode D and start the heating mode H.

Meanwhile, if the storage chamber temperature is lowered to 15.5° C. or less and then further lowered to 13.5° C. or less, the controller 30 can count the time for which the storage chamber temperature is maintained at 13.5° C. or less, and if the counted time is equal to or greater than the second set time (for example, 5 minutes), the controller 30 can end the standby mode D and start the heating mode H. In other words, the controller may start the heating mode H when any one of the first starting condition (exceeding the first set time) or the second starting condition (e.g., exceeding the second set time while the temperature is below a lower limit temperature) of the heating mode H is satisfied during the standby mode.

Meanwhile, after the storage chamber temperature is lowered to 13.5° C. or less and before the being reached second set time (for example, 5 minutes), the user can lower the target temperature to 14° C. When the target temperature is changed, the controller 30 can change, for example, the target temperature lower limit value to 13.5° C., change the lower limit temperature to 11.5° C., change the target temperature the upper limit value to 14.5° C., and change the upper limit temperature to 16.5° C.

The controller 30 can compare the storage chamber temperature with the newly changed lower limit temperature of 11.5° C., and when the storage chamber temperature is higher than the newly changed lower limit temperature of 11.5° C., the controller 30 does not switch from the standby mode D to the heating mode H. In this case, the controller 30 may switch from the standby mode D to the cooling mode E when the storage chamber temperature is equal to or higher than the newly changed target upper limit value of 14.5° C. In other words, the refrigerator may quickly respond to a change in the target temperature of the user and minimize the deterioration of the quality of the goods stored in the storage chamber W.

Another example of the standby mode D may be a mode when the storage chamber temperature is maintained between the target temperature upper limit value and the upper limit temperature, and the refrigerator does not immediately switch to the cooling mode E during the heating mode H and can be controlled in the order of the heating mode H, the standby mode D, and the cooling mode E. In this case, the refrigerator may maintain the standby mode D after the end of the heating mode H, and when the starting condition of the cooling mode E is reached during the standby mode (D), the refrigerator can be switched from the standby mode D to the cooling mode E.

After the heating mode H is ended, if the time for which the storage chamber temperature is between the target temperature upper limit value and the upper limit temperature is equal to or greater than the first set time T1 (for example, 100 minutes), the refrigerator can be switched from the standby mode D to the cooling mode E. After the heating mode H is ended, the condition that the time for which the storage chamber temperature is between the target temperature upper limit value and the upper limit temperature is equal to or greater than the first set time T1 (for example, 100 minutes) may be the first starting condition of the cooling mode E.

The temperature of the storage chamber W, which has been temperature-adjusted in the heating mode H, may sometimes be maintained above the target temperature upper limit value without lowering back to the target temperature upper limit value or less for a long time in a state where the temperature of the storage chamber W rises above the target temperature upper limit value. The case may occur when the standby mode D is maintained for a long time after the heating mode H is ended, and the refrigerator cannot be returned to the heating mode H again. If the storage chamber W is maintained for a long time without being lowered to the target temperature range in a state of being higher than the target temperature range, deterioration of the quality of the goods stored in the storage chamber W may occur, and since the temperature of the storage chamber W cannot be lowered using the heating device, the controller 30 may stop the standby mode D and start the cooling mode E in order to lower the temperature of the storage chamber W by the cooling device.

In some examples, after the heating mode H is ended and the time for which the storage chamber temperature is higher than the upper limit temperature is equal to or greater than the second set time T2 (for example, 5 minutes), the refrigerator can be switched from the standby mode D to the cooling mode E. The second set time (for example, 5 minutes) may be shorter than the first set time (for example, 100 minutes). After the heating mode H is ended, the condition that the time for which the storage chamber temperature is higher than the upper limit temperature is equal to or greater than the second set time T2 (for example, 5 minutes) may be the second starting condition of the cooling mode E.

When the temperature of the storage chamber W, which has been temperature-adjusted in the heating mode H, reaches the upper limit temperature higher than the target temperature upper limit value, the temperature of the storage chamber W may be excessively higher than the target temperature range. In this case, the controller 30 can stop the standby mode D and start the cooling mode E in order to lower the temperature of the storage chamber W by the cooling device before reaching the first set time (for example, 100 minutes).

After the heating mode H is ended, if the storage chamber temperature is higher than the upper limit temperature, the controller 30 does not wait for the second set time (for example, 5 minutes) and then can immediately switch from the standby mode D to the cooling mode E. However, as described in the switching from the standby mode D to the heating mode H, the user may input a new target temperature, and the refrigerator may not quickly respond to the new target temperature input by the user. For example, after the heating mode H is ended and the storage chamber temperature is higher than the upper limit temperature and the second set time (for example, 5 minutes) elapses, the refrigerator may be switched from the standby mode D to the cooling mode E.

For convenience of explanation, a case where the target temperature is 16° C., the target temperature lower limit value is 15.5° C., the lower limit temperature is 13.5° C., the target temperature upper limit value is 16.5° C., and the upper limit temperature is 18.5° C. will be described as an example. After the storage chamber temperature rises to 16.5° C. or more (e.g., in heating mode H), the storage chamber temperature can be maintained for a long time between 16.5° C. and 18.5° C. without being lowered to 16.5° C. or less (e.g., in standby mode D). The controller 30 can count the time for which the storage chamber temperature is maintained between 16.5° C. and 18.5° C., and if the counted time is equal to or greater than the first set time (for example, 100 minutes), the controller 30 may end the standby mode D and start the cooling mode E.

Meanwhile, after the storage chamber temperature rises to 16.5° C. or more, if the storage chamber temperature is 18.5° C. or more, the controller 30 may count the time for which the storage chamber temperature maintains 18.5° C. or more, and if the counted time is equal to or greater than the second set time (for example, 5 minutes), the controller 30 may end the standby mode D and start the cooling mode E. Thus, the controller 30 may start the cooling mode E when any one of the first starting condition or the second starting condition of the cooling mode E is satisfied during the standby mode E.

In another implementation, the plurality of modes of a refrigerator may further include a humidification mode for increasing the humidity of the storage chamber. The humidification mode may be, for example, a mode in which at least some of the cooling devices are in an off state (for example, the supply of refrigerant to the evaporator is interrupted or the thermoelectric element is off); at least some of the heating device are maintained in the off state (for example, the heater is off or the thermoelectric element is off); a fan is activated such that air in the storage chamber W may flow into the cooling device chamber to be humidified; and the humidified air may flow into the storage chamber W to humidify the storage chamber. For example, the humidification mode may be a mode in which in a state where the refrigerant does not pass through the evaporator and the heater maintains a state of turning off, the air in the storage chamber flows to the evaporator to be humidified, and the humidified air flows into the storage chamber to humidify the storage chamber. Thus, in the humidification mode, a fan that circulates air in the storage chamber to the evaporator and the storage chamber may be driven.

Figure 5:
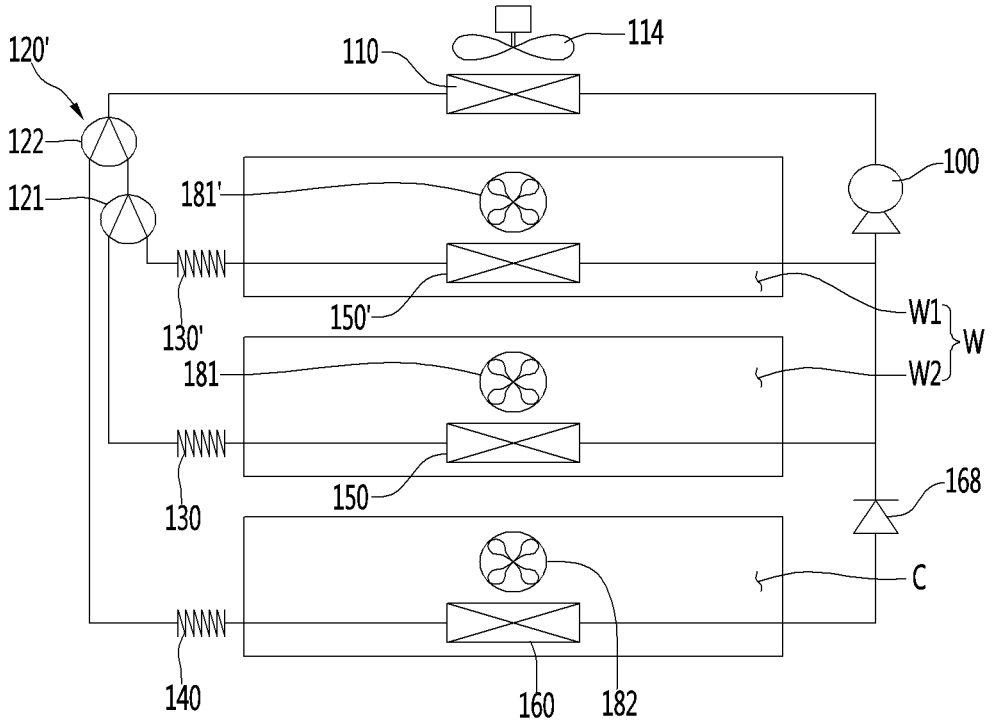
FIGS. 5 to 8 are views illustrating examples of a refrigeration cycle of a refrigerator according to an embodiment of the present disclosure.
Figure 6:
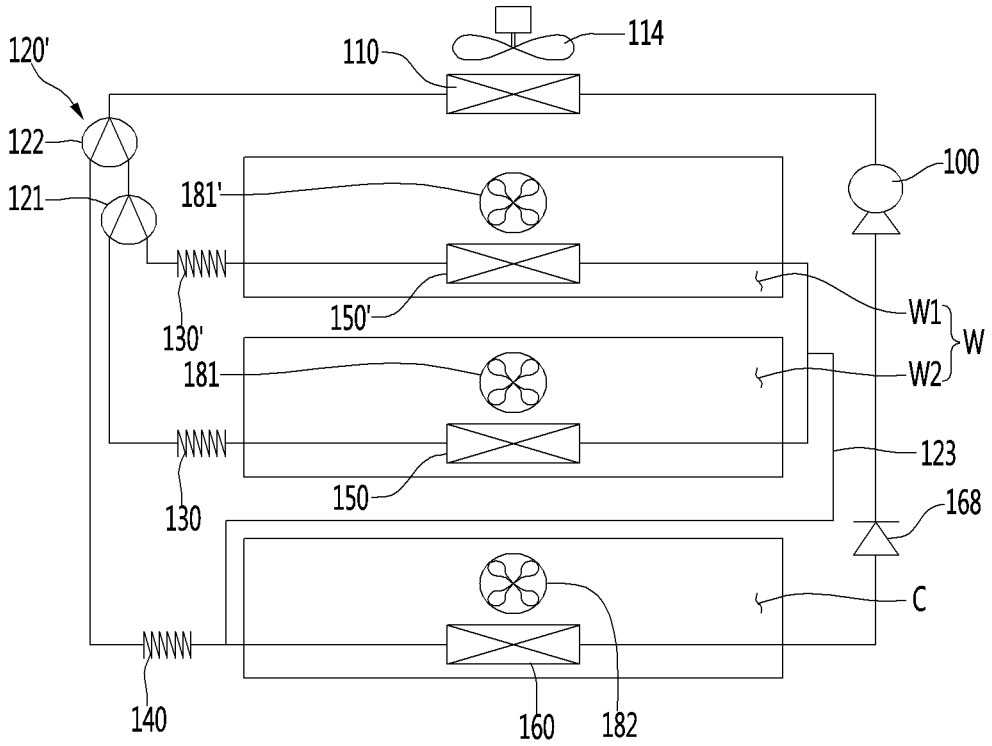
Figure 7:
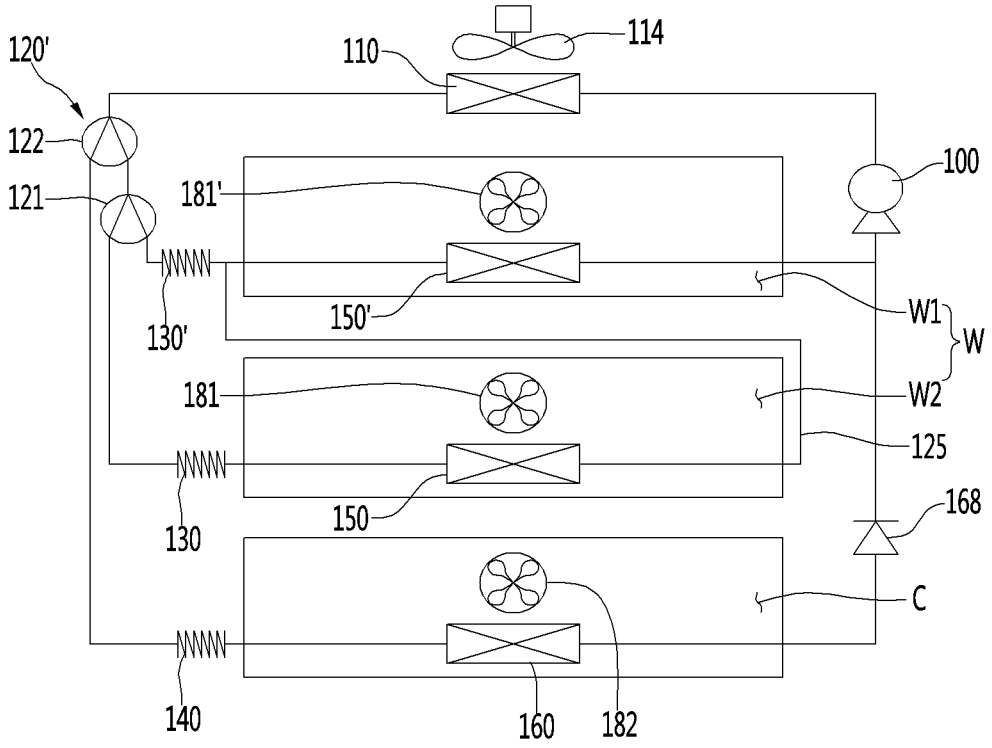
Figure 8:
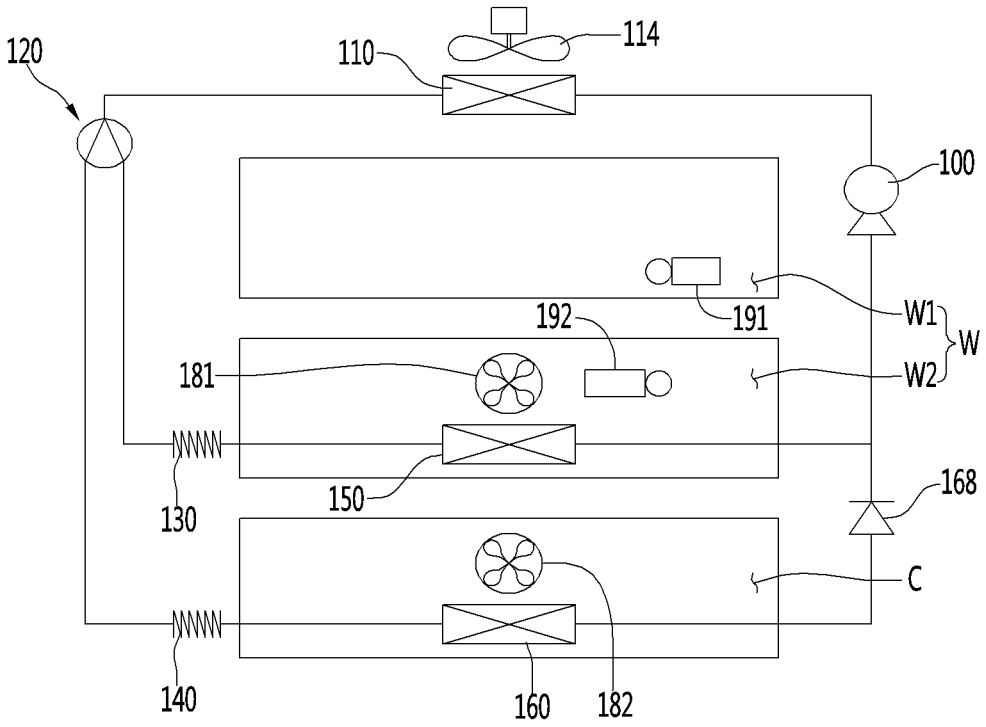

FIG. 5 is a view illustrating a first example of a refrigeration cycle of a refrigerator according to an embodiment of the present disclosure, FIG. 6 is a view illustrating a second example of a refrigeration cycle of a refrigerator according to an embodiment of the present disclosure, FIG. 7 is a view illustrating a third example of a refrigeration cycle of a refrigerator according to an embodiment of the present disclosure, and FIG. 8 is a diagram illustrating a fourth example of a refrigeration cycle of a refrigerator according to an embodiment of the present disclosure.

The refrigeration cycles illustrated in FIGS. 5 to 8 may be applied to a refrigerator having three spaces (hereinafter, referred to as first, second, and third spaces) that may have different storage temperature ranges from each other. For example, the refrigeration cycles may be applied to at least one of i) a refrigerator having a first space W1, a separate second space W2, and a separate third space W3, ii) a refrigerator having a first storage chamber W having the first space W1 and the second space W2, and a second storage chamber C partitioned from the first storage chamber W, or iii) a refrigerator having a first storage chamber W and second and third storage chambers partitioned from the first storage chamber W.

The refrigeration cycle illustrated in FIGS. 5 to 7 may include a compressor 100, a condenser 110, a plurality of expansion mechanisms (or valves) 130',130, 140, and a plurality of evaporators 150',150, 160 and may further include a flow path switching mechanism (or refrigerant valves) 120'. A case where the first region is the first space W1, the second region is the second space W2, and the third region is the second storage chamber C will be described below. The first, second, and third regions are also applicable to cases ii) and iii) described above.

The plurality of evaporators 150',150, 160 may include a pair of first evaporators 150',150 capable of independently cooling the first space W1 and the second space W2, respectively, and a second evaporator 160 that can cool a second storage chamber C. One of the pair of first evaporators 150' and 150 may be an evaporator 150' cooling the first space W1, and the other of the pair of first evaporators 150' and 150 may be an evaporator 150 cooling the second space W2.

The plurality of expansion mechanisms 130',130, and 140 may include a pair of first expansion mechanisms 130' and 130 connected to a pair of first evaporators 150' and 150, and a second expansion mechanism 140 connected to a second evaporator 160. Any one of the pair of first expansion mechanisms 130' and 130 may be an expansion mechanism 130' connected to any one 150' of the pair of first evaporators 150' and 150, and the other of the pair of first expansion mechanisms 130' and 130 may be an expansion mechanism 130 connected to the other one 150 of the pair of first evaporators 150' and 150.

The flow path switching mechanism 120' may include a first valve 121 capable of controlling a refrigerant flowing into the pair of first expansion mechanisms 130' and 130, and a second valve 122 capable of controlling a refrigerant flowing into the first valve 121 and the second expansion mechanism 140.

The refrigerator having the refrigeration cycle illustrated in FIGS. 5 to 7 may include a pair of first fans 181' and 181, and a second fan 182 for circulating cold air in the space of the second storage chamber C to the space of the second evaporator 160 and the second storage chamber C and may further include a condensation fan 114 for blowing outside air to the condenser 110. Any one 181' of the pair of first fans 181' and 181 may be a fan for the first space in which cold air in the first space W1 can be circulated into any one 150' of the pair of first evaporators 150' and 150 and the first space W1. In addition, the other one 181 of the pair of fans 181' and 181 may be a fan the second space in which cold air in the second space W2 can be circulated into any one 150 of the pair of first evaporators 150' and 150 and the second space W2.

The refrigeration cycle illustrated in FIG. 5 may include a first parallel flow path in which a pair of first evaporators 150' and 150 are connected in parallel and a second parallel flow path in which a pair of first evaporators 150' and 150 are connected to the second evaporator 160 in parallel. In this case, a one-way valve 168 may be installed at an outlet side of the second evaporator 160 to prevent the refrigerant at the outlet side of the second evaporator 160 from flowing back to the second evaporator 160.

The refrigeration cycle illustrated in FIG. 6 may include a parallel flow path in which a pair of first evaporators 150' and 150 are connected in parallel and a serial flow path 123 in which the pair of first evaporators 150' and 150 are connected to a second evaporator 160 in series. One end of the serial flow path 123 may be connected to a parallel flow path in which a pair of first evaporators 150' and 150 are connected in parallel. The other end of the serial flow path 123 may be connected between the second expansion mechanism 140 and the inlet of the second evaporator 160. In this case, a one-way valve 168 may be installed at the outlet side of the second evaporator 150 to prevent the refrigerant at the outlet side of the second evaporator 160 from flowing back to the second evaporator 160.

The refrigeration cycle illustrated in FIG. 7 may include a serial flow path 125 in which a pair of first evaporators 150' and 150 are connected in series, and, a parallel flow path in which the pair of first evaporators 150' and 150 are connected to the second evaporator 160 in parallel. One end of the serial flow path 125 may be connected to the outlet side of any one 150 of the pair of first evaporators 150' and 150. The other end of the serial flow path 125 may be connected to an inlet side of the other 150' of the pair of first evaporators 150' and 150'. In this case, a one-way valve 168 may be installed at the outlet side of the second evaporator 160 to prevent the refrigerant at the outlet side of the second evaporator 160 from flowing back to the second evaporator 160.

The refrigeration cycle illustrated in FIG. 8 may include one first evaporator 150 instead of the pair of first evaporators 150' and 150 illustrated in FIGS. 5 to 7, and one first expansion mechanism 130 instead of the pair of expansion mechanism 130' and 130. In addition, the refrigeration cycle illustrated in FIG. 8 may include a flow path switching mechanism (or valve) 120 for controlling the refrigerant flowing into the first expansion mechanism 130 and the second expansion mechanism 140, and the flow path switching mechanism 120 may include a refrigerant valve that can be switched so that the refrigerant flowing from the condenser 110 flows to the first expansion mechanism 130 or the second expansion mechanism 140. In addition, a one-way valve 168 may be installed at the outlet side of the second evaporator 160 to prevent the refrigerant at the outlet side of the second evaporator 160 from flowing back to the second evaporator 160.

Since other configurations and actions other than one first evaporator 150, one first expansion mechanism 130, a flow path switching mechanism 120, and a one-way valve 168 of the refrigeration cycle illustrated in FIG. 8 are the same as or similar to those of the refrigeration cycle illustrated in FIGS. 5 to 7, a detailed description with respect to those will be omitted.

In addition, the refrigerator having a refrigeration cycle illustrated in FIG. 8 may include a first fan 181 circulating cold air of the first storage chamber W into the first evaporator 150 and the first storage chamber W instead of the pair of first fans 181' and 181 illustrated in FIGS. 5 to 7. In addition, the refrigerator having the refrigeration cycle illustrated in FIG. 8 may include a first damper 191 for controlling cold air flowing into the first space W1 after being cooled by the first evaporator 150 and a second damper 192 for controlling the cold air flowing into the second space W2 after being cooled by the first evaporator 150. Only one of the first damper 191 and the second damper 192 may be provided. Meanwhile, in the refrigerator, one damper may selectively supply air cooled by the evaporator 150 to at least one of the first space W1 and the second space W2.

Modification of the examples of the refrigeration cycle illustrated in FIGS. 5 to 8 may be applied to a refrigerator having two spaces having different storage temperature ranges from each other. In other words, the modification examples of the refrigeration cycle may be applied to a refrigerator having a first space W1 and a second space W2 or a refrigerator having a first storage chamber W and a second storage chamber C. In certain examples, the refrigeration cycle can be configured with a cycle which does not include the flow path switching mechanisms 120 and 122, the second expansion mechanism 140, the second evaporator 160, the second fan 182, and the one-way valve 168. Furthermore, the refrigeration cycle illustrated in FIGS. 5 to 8 may constitute a cooling device capable of cooling the storage chamber.

Figure 9:
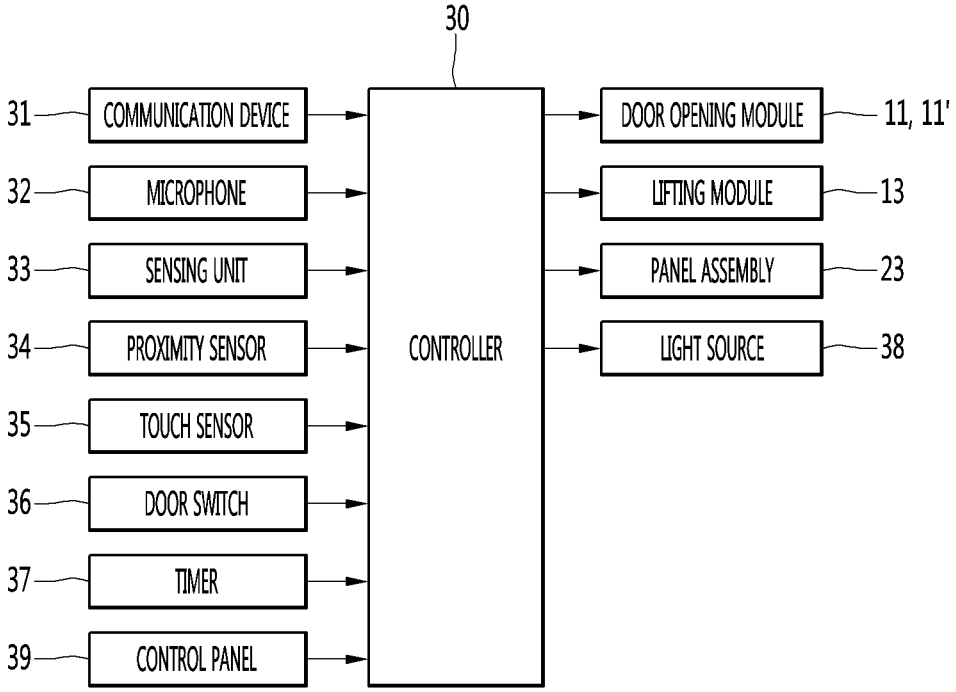
FIG. 9 is a control block diagram of a refrigerator according to an embodiment of the present disclosure.

FIG. 9 is a control block diagram illustrating a refrigerator according to an embodiment of the present disclosure. The refrigerator may include a controller 30 that controls various electronic devices such as a motor provided in the refrigerator. The controller 30 may control the refrigerator according to the input value provided via an input device or otherwise determined by the refrigerator.

The input device may include at least one of a communication device 31 which receives a signal from an external device such as a remote controller such as a remote controller or a mobile terminal such as a mobile phone, a microphone 32 that changes a user's voice to a sound signal, a sensing unit 33 which can sense a user's motion, a proximity sensor 34 (or a distance sensor) which can sense the user's proximity, a touch sensor 35 which can sense the user's touch, a door switch 36 which can detect the opening and closing of the door, a timer 37 which can measure the lapse of time, or a control panel 39 which can input various input values such as the target temperature by the user.

As previously described, the refrigerator may include a see-through door. The see-through door may be a door that can selectively switched between a first state in which the door is at least partially transparent and a user can see through the door (a see-through activation state), and a second state in which the door is at least partially opaque and a user cannot see through the door (a see-through deactivation state). The see-through door may be a door that is changed from a see-through deactivation state to a see-through activation state or is changed from a see-through activation state to a see-through deactivation state according to an input value provided to the controller 30 through the input device. In another example, the see-through door may be a door in which the see-through door is changed from see-through deactivation state to see-through activation state when the see-through door is closed and according to an input value provided to the controller 30 through the input device.

An example of an operation method according to the input device is now described. The sensing unit 33 may include a vibration sensor. For example, the vibration sensor may be disposed on the rear surface of the front panel, and the vibration sensor may be formed in black such that visible exposure of the vibration sensor may be minimized. For example, the sensing unit 33 may include a microphone or other audio sensor disposed, for example, on the rear surface of the front panel, and the microphone may sense sound waves of vibration applied to the front panel. When a user provides a particular input, such as tapping the panel assembly 23 a plurality of times at a predetermined time interval, the specific input may be detected through the sensing unit 33, and the controller 30 may change the see-through door to be activated or deactivated based on the detected input. Additionally or alternatively, the sensing unit 33 may be a device for imaging a user's motion, such as a camera. It may be determined whether the image photographed by the sensing unit 33 is similar or identical to a specific motion input in advance, and may be changed to activate or deactivate the see-through door according to the determination result.

Similarly, if it is determined that the user or a part of the user (e.g., the user's hand) is positioned within a predetermined distance or less (e.g., 30 cm or less) of a portion of the refrigerator according to the value detected by the proximity sensor 34, the see-through door may be changed between the activated or deactivated states. In another example, the see-through door may be changed between the activated or deactivated states when it is determined that the user positioned with a predetermined distance or less and is moving toward the refrigerator according to the value detected by the proximity sensor 34.

In another example, when the controller 30 determines that the door is closed according to the value detected by the door switch 36, the see-through door may be activated, and when it is determined that the door is open, the see-through door may be changed to be inactivated. For example, the see-through door may be in the deactivated state when opened and may remain in the deactivated state when closed, until a particular input is received that prompts the see-through door to be switched to the activated state.

The see-through door may be controlled to be deactivated after a certain time elapses after being activated according to the value input through the timer 37. For example, the see-through door may be controlled to be deactivated after a certain time elapses after an input to activate the see-through door is received. In another example, according to the value input through the timer 37, the see-through door may be controlled to be activated when a predetermined time elapses after being deactivated.

As an example in which the see-through door is activated or deactivated, there may be a case where the transparency of the see-through door itself may vary. For example, the see-through door may remain opaque when no current is applied to the panel assembly 23 and may be changed to be transparent when current is applied to the panel assembly 23. In another example, when the light source 38 installed inside the see-through door is turned on, the user may see the storage chamber through the see-through door by the light emitted from the light source 38 when active.

The light source 38 may make the panel assembly 23 appear transparent or translucent so that an inside of the refrigerator (a side of the storage chamber relative to the panel assembly) looks brighter than outside of the refrigerator (outside relative to the panel assembly). The light source 38 may be mounted on the light source mounting portion that is formed on the cabinet 1. In another example, the light source mounting portion may be formed on the door and may be disposed to emit light toward the panel assembly 23.

As described below, the controller 30 may also control the door opening module 11 according to the input value of the input device. Likewise, the controller 30 may control the lifting module 13 according to the input value of the input device.

Figure 10:
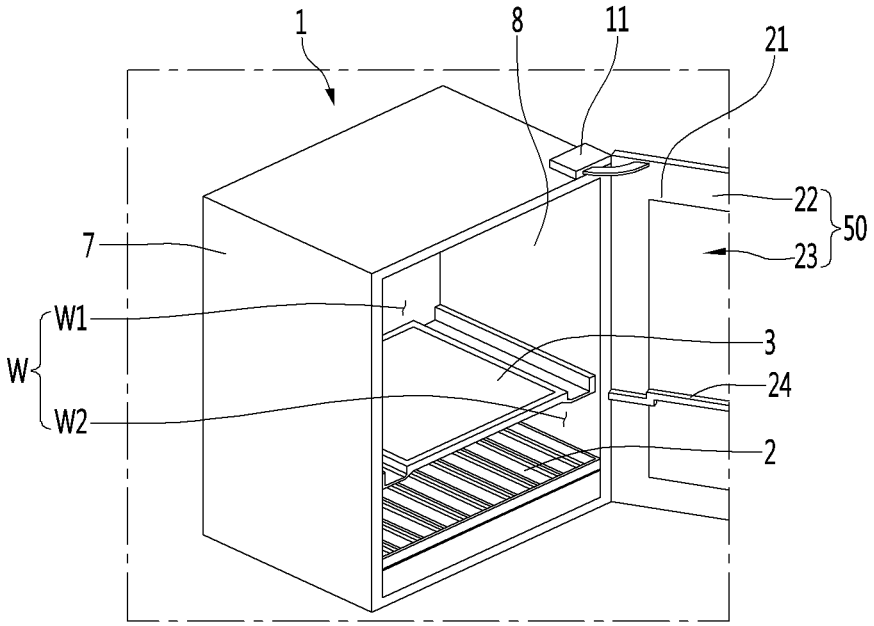
FIG. 10 is a perspective view illustrating a see-through door of a refrigerator according to an embodiment of the present disclosure.

FIG. 10 is a perspective view illustrating a see-through door of a refrigerator according to an embodiment of the present disclosure. The refrigerator may include a door (hereinafter, a see-through door) through which a user may view the storage chamber through a see-through window without opening the door 50 from the outside of the refrigerator. The see-through door may include an outer door 22 and a panel assembly 23.

The outer door 22 may be opaque, and an opening portion 21 may be formed in (e.g., in a central region) of the outer door 22. The outer door 22 may form an outer appearance of the see-through door. The outer door 22 may be rotatably connected to or connected to the cabinet 1 to be capable of being advanced and retracted to open storage chamber W. The panel assembly 23 may be disposed in the opening portion 21. The panel assembly 23 may be disposed to shield the opening portion 21. The panel assembly 23 can form the same outer appearance as the front surface of the outer door 22.

The see-through door may be provided to open and close the storage chamber which mainly stores goods (for example, wine) having a large quality change according to the temperature change (e.g., the goods are preferable stored in a narrow temperature range to preserve a quality of the goods). In a case where goods having a large quality change due to temperature change are mainly stored in the storage chamber W, the storage chamber W is preferably opened and closed as short as possible, the number of opening and closing is preferably minimized, and the see-through door is preferably installed to open and close the storage chamber W so that a user may view goods within the storage chamber without opening the door and disturbing the temperature within the storage chamber. For example, the see-through door may be provided in the door for opening and closing at least one of a specific goods storage chamber, a constant temperature chamber, or a priority storage chamber.

Figure 11:
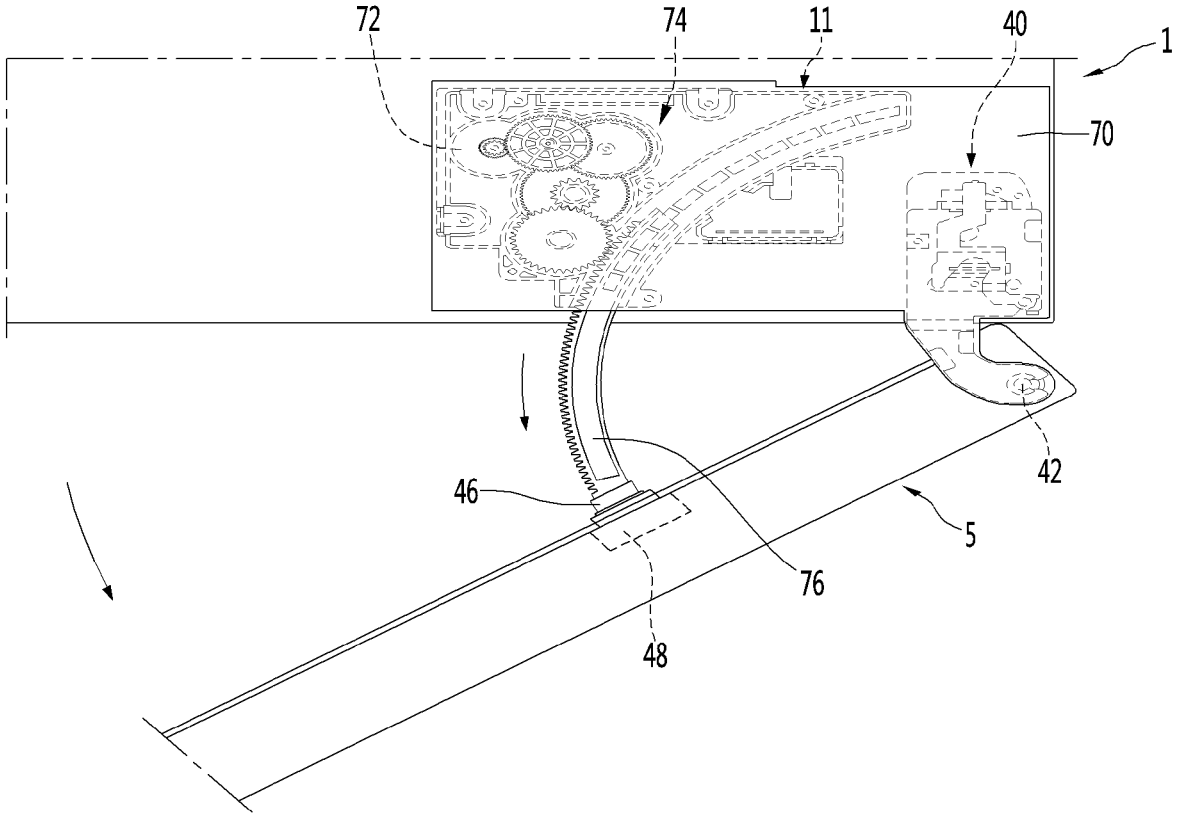
FIG. 11 is a plan view when an example of a door according to an embodiment of the present disclosure is opened in a door opening module.

FIG. 11 is a plan view when an example of a swinging-type door according to an embodiment of the present disclosure is opened in a door opening module. In the refrigerator, a door opening and closing the storage chamber may be an automatic door, and the door for opening and closing the specific goods storage chamber, the constant temperature chamber, and a priority storage chamber may be an automatic door. The refrigerator may include a door opening module 11 that provides a force for automatically opening the door 5. For example, the automatic door may be controlled to be opened or closed according to an input value provided to the controller 30 through the input device. For this purpose, the controller 30 may control the door opening module 11.

The door opening module 11 may automatically open the door 5 rotatably connected to the cabinet 1. The door 5 may be a rotary automatic door that is automatically opened by the door opening module 11. The cabinet 1 may be provided with a hinge mechanism 40 in which the hinge shaft 42 is connected to the door 5. The refrigerator may further include a module cover 70 that may cover the hinge mechanism 40 and the door open module 11 together. In addition, the door opening module 11 may include a drive motor 72, a power transmission unit (also referred as a transmission or gearing) 74, and a push member (or rack) 76.

When the refrigerator is turned on, the controller 30 may wait to receive an open command of the door 5. When the door opening command is input through the input device, the controller 30 may transmit an opening signal to the drive motor 72 included in the door opening module 11. When the controller 30 transmits an opening signal to the drive motor 72, the drive motor 72 may be rotated in a first direction to move the push member 76 from the initial position to the door opening position. For example, when the drive motor 72 rotates in the first direction, the power transmission unit 74 may transmit a first direction rotational force of the drive motor 72 to the push member 76, and the push member 76 may push the door while protruding forward, and the door 5 may be rotated in the forward direction with respect to the cabinet 1.

The controller 30 may determine whether the push member 76 has reached the door opening position in a process of rotating in the first direction of the drive motor 72. For example, the controller may determine that the push member 76 has reached the door opening position when the cumulative rotational speed of the drive motor 72 reaches the reference rotational speed. The controller 30 may stop the rotation of the drive motor 72 when it is determined that the push member 76 has moved to the door opening position.

In a state where the door 5 is rotated by a predetermined angle, the user can manually increase the opening angle of the door 5. When the user increases the opening angle of the door in a state where the push member 76 moves the door 5 to the door opening position, the door sensor, such as a magnet 46 and a reed switch 48, can sense the manual opening of the door 5, and if the manual opening of the door 5 is sensed by the door sensor, the controller 300 can output a return signal to the drive motor 72.

The controller 30 may transmit the return signal to the drive motor 72 so that the push member 76 returns to the initial position by the drive motor 72 being reversely rotated in a second direction opposite to the first direction. If it is determined that the push member 76 has returned to the initial position, the controller 30 may stop the drive motor 72.

Figure 12:
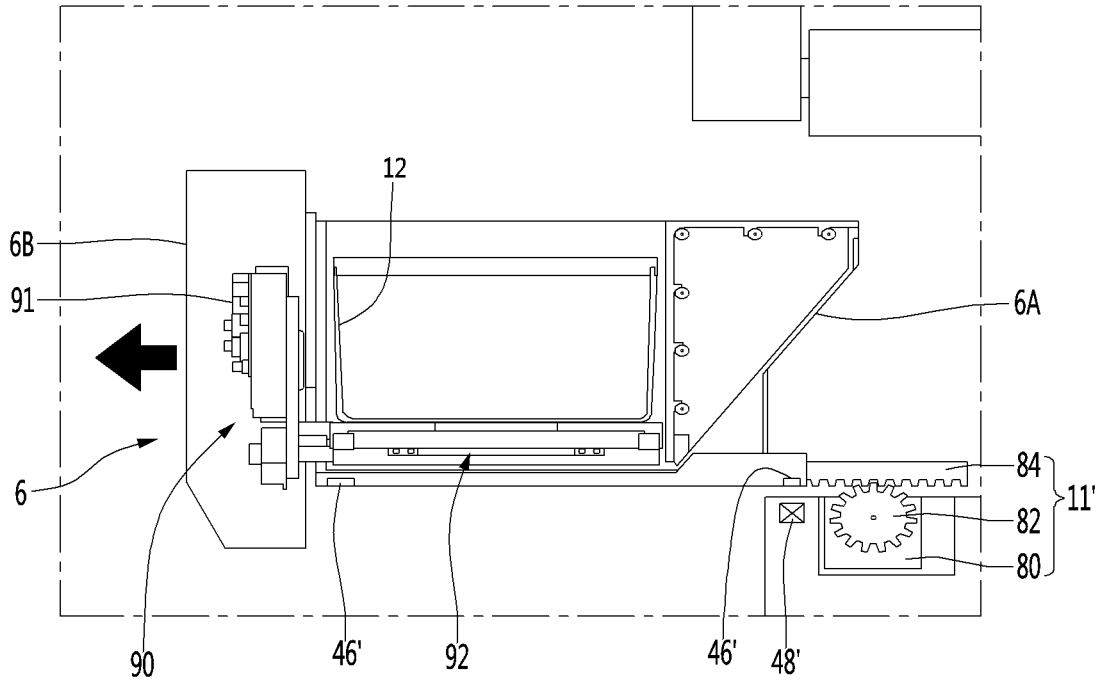
FIG. 12 is a cross-sectional view when another example of a door according to an embodiment of the present disclosure is opened by the door opening module.

FIG. 12 is a sectional view when another example of a door according to an embodiment of the present disclosure is opened by a door opening module 11'. In the example shown in FIG. 12, the door is drawer that may be automatically opened by the door opening module 11' that applies an outward force.

The door opening module 11' illustrated in FIG. 12 may automatically open the door (or drawer) 6 disposed in the cabinet 1 to be capable of being advanced and retracted. The refrigerator may include a first door provided at a relatively higher at a greater height and a second door that is relatively lower and having a smaller height, and the door opening module 11' may be installed to automatically open a door having a lower height than other doors. Such a door may be a retractable automatic door which is automatically opened by the door opening module 11'. The door 6 advanced and retracted by the door opening module 11' may include a drawer body (or bin) 6A and a door body (or drawer front) 6B disposed at the drawer body 6A to open and close the storage chamber.

The door opening module 11' may include a drive motor 80, a pinion 82, and a rack 84. The pinion 82 may be connected to the rotation shaft of the drive motor 80. The rack 84 may extend from the door 6, in particular, the drawer body 6A. The refrigerator may further include a door sensor that senses a position of the door 6, and the door sensor may sense a pair of magnets 46' spaced apart from the door 6 and a reed switch (or Hall sensor) 48' sensing the magnet 46'.

When the power of the refrigerator is turned on, the controller 30 may wait to receive an opening command of the door 6. When the door opening command is input through the input device, the controller 30 may transmit an opening signal to the drive motor 80.

The drive motor 80 may be activated to rotate in the first direction by the controller 30 when an opening signal is input, and the pinion 82 and the rack 84 may transmit the rotational force of the drive motor 80 to the drawer body 82. The drawer body 6A may advance the door body 6B while advancing forward in the storage chamber, and the door body 6B can be advanced to be spaced apart from the cabinet 1 toward the front of the cabinet 1. The controller 30 may sense that the door 6 has reached the opening position by the door sensor, and when the door 6 has reached the opening position, the controller 30 may stop the rotation of the drive motor 80.

When the drawer body 6A is advanced as described above, the upper surface of the drawer body 6A may be exposed. In a state where the drawer body 6A is advanced to the opening position, the user can enter a door closing command such that the drawer body 6A retracts to the closing position via the input device. For example, if the motion sensed by the sensing unit 33 coincides with a specific motion, the controller 30 may transmit a close signal to the drive motor 80. In another example, the controller 30 may sense the proximity of the user by the proximity sensor 34 and transmit a closing signal to the drive motor 80 when the proximity sensor 34 detects that the user has moved more than a predetermined distance (e.g., toward the proximity sensor 34).

When the close signal is input, the drive motor 80 may be reversely rotated in a second direction opposite to the first direction. In reverse rotation of the drive motor 80, the pinion 82 and the rack 84 can transmit the rotational force of the drive motor 80 to the drawer body 6A, and while the drawer body 6A retracts into the storage chamber, the door body 6B can be retracted and the door body 6B can be retracted in close contact with the cabinet 1 toward the front of the cabinet 1. The controller 30 may sense that the door 6 has reached the closing position by the door sensor, and if the door 6 has reached the closing position, the controller 30 may stop the reverse rotation of the drive motor 80.

Figure 13:
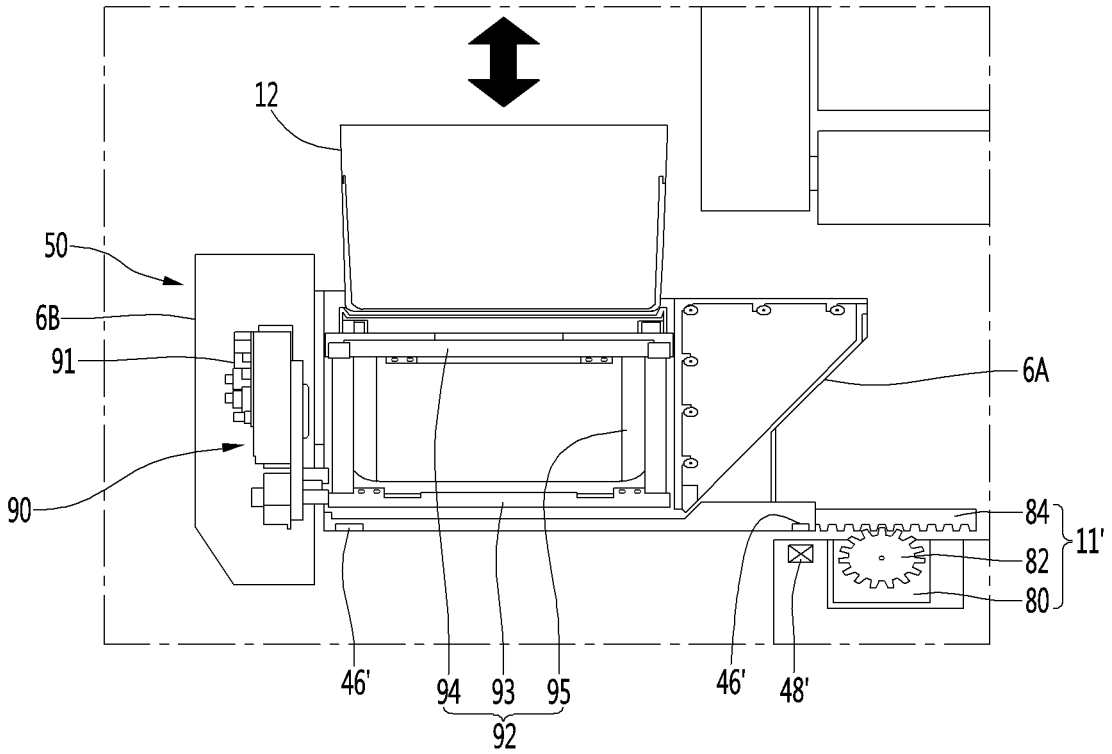
FIG. 13 is a sectional view when a holder illustrated in FIG. 12 is lifted.

FIG. 13 is a sectional view illustrating when the holder 12 lifts while the door is opened according to the embodiment of the present disclosure. As previously described, the refrigerator may further include a lifting module (also referred to as a lift or elevator) 13 which allows the holder 12 to be automatically lifted and lowered after the holder 12 is moved forward in a state where the door 50 is opened. The holder 12 may be a shelf, a drawer, a basket, or the like on which goods can be placed. The lifting module 13 may be disposed in the storage chamber or at least one of the rotatable door 5 and the advancing and retracting type door 6 for opening and closing the storage chamber. The refrigerator may have both a first holder provided higher at a greater height and a second holder provided lower at a smaller lower height.

The lifting module 13 may be disposed in a low storage chamber associated with a holder 12 having a lower height than other holders 12. In another example, the lifting module 13 may function for lowering a holder and may be arranged in a storage chamber in which a holder having a relatively greater height than other holders is located.

An example of the lifting module 13 will be described. An example of the lifting module 13 may include a lower frame 93, an upper frame 94, a lifting and lowering mechanism 92 having at least one link 95, and a drive mechanism 90 capable of lifting and lowering the upper frame 94. The drive mechanism 90 may include a lifting and lowering motor 91 and a power transmission member connected to the lifting and lowering motor 91 to transfer the drive force of the lifting and lowering motor 91 to the upper frame 94.

When the refrigerator is turned on, the controller 30 may wait for a lifting command of the holder 12 to be input. When the lifting command is input through the input device, the controller 30 may transmit a lifting signal to the lifting and lowering motor 91 included in the lifting module 13. In another example, the controller 30 may automatically generate the lifting command when a drawer is fully opened and other, higher drawers are closed. When the controller 30 transmits an opening signal to the lifting and lowering motor 91, the lifting and lowering motor 91 may rotate in a first direction and the upper frame 94 may lift the holder 12 to the upper side of the drawer body 6B.

The user may input a lowering command through the input device, and the controller 30 may transmit a lowering signal to the lifting and lowering motor 91 when the lowering command is input through the input device. In another example, the controller 30 may automatically generate the lowering command when a lifted drawer is being closed or other, higher drawers start to be closed. For example, the lifting and lowering motor 91 may be reversely rotated in a second direction opposite to the first direction. Upon reverse rotation of the lifting and elevating motor 91, the upper frame 94 may be lowered to the inner lower portion of the drawer body 82, and the holder 12 may be inserted into the drawer body 6B together with the upper frame 94. In another example, the lifting and lowering motor 91 may be rotating in a same direction when lowering or lifting the holder 12, and a vertical movement direction may be adjusted by a power transmission member, such as to adjust a quantity and/or position of gears to receive a rotational force of the lifting and lowering motor 91.

Figure 14:
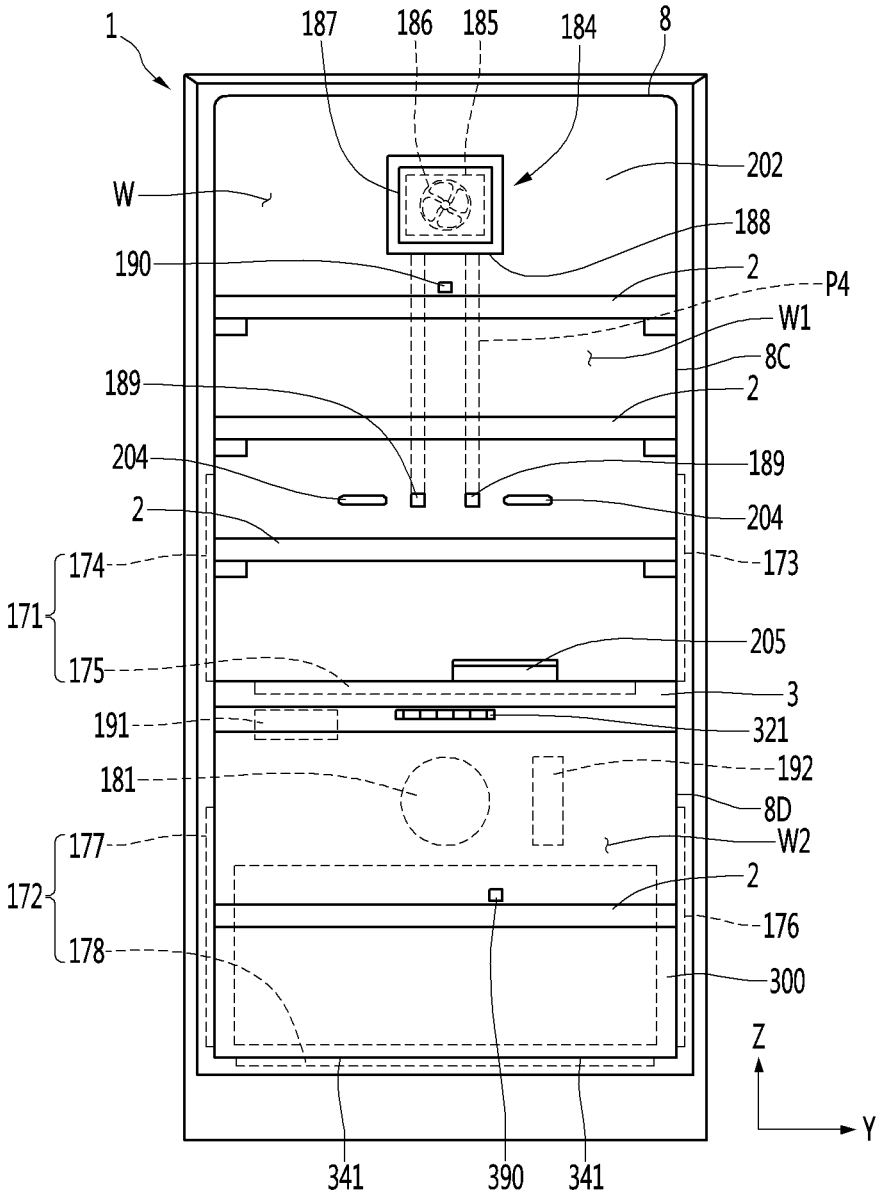
FIG. 14 is a front view illustrating a storage chamber of a refrigerator according to an embodiment of the present disclosure.
Figure 15:
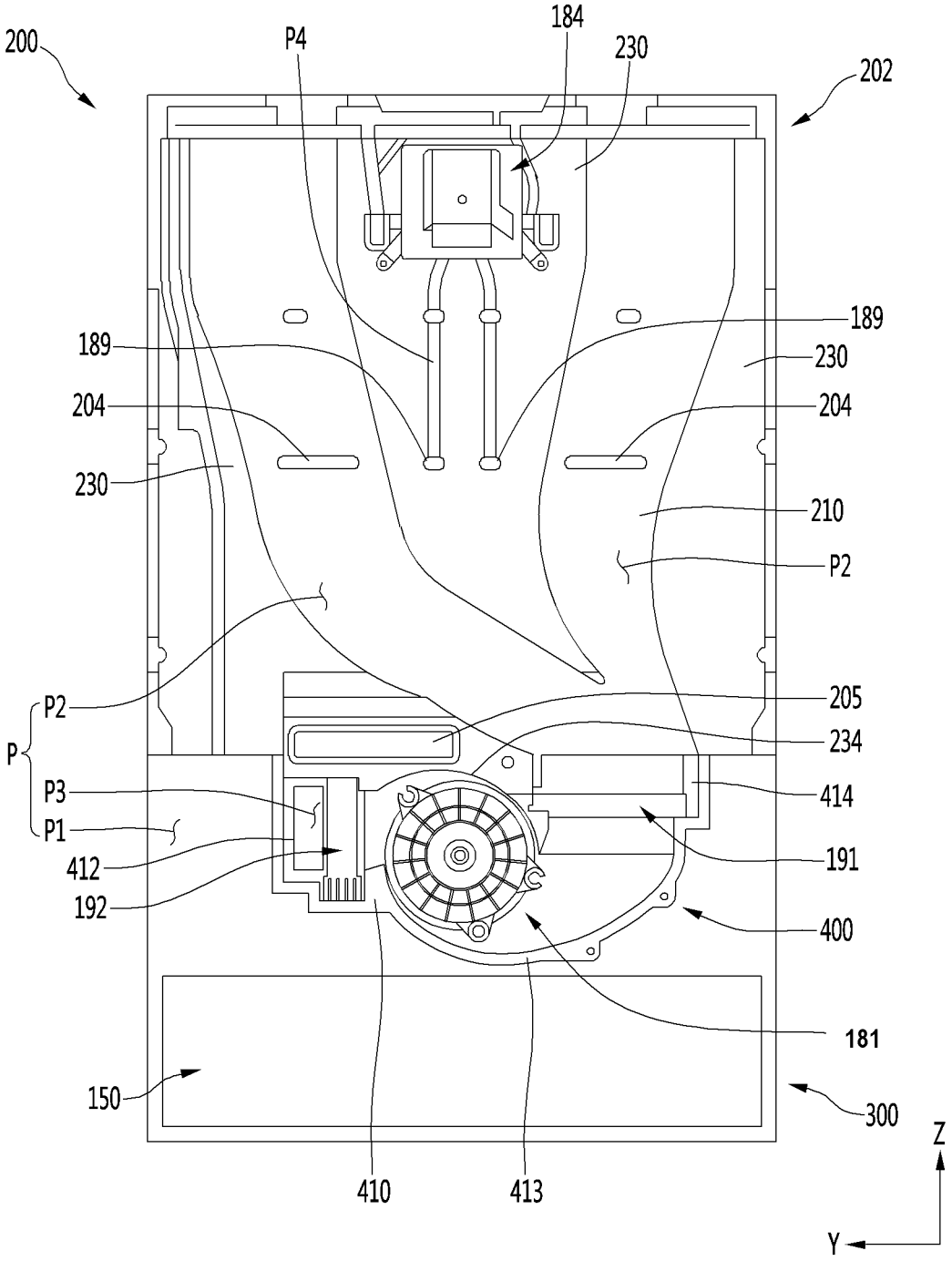
FIG. 15 is a rear view illustrating an inner portion of the inner guide according to an embodiment of the present disclosure.
Figure 16:
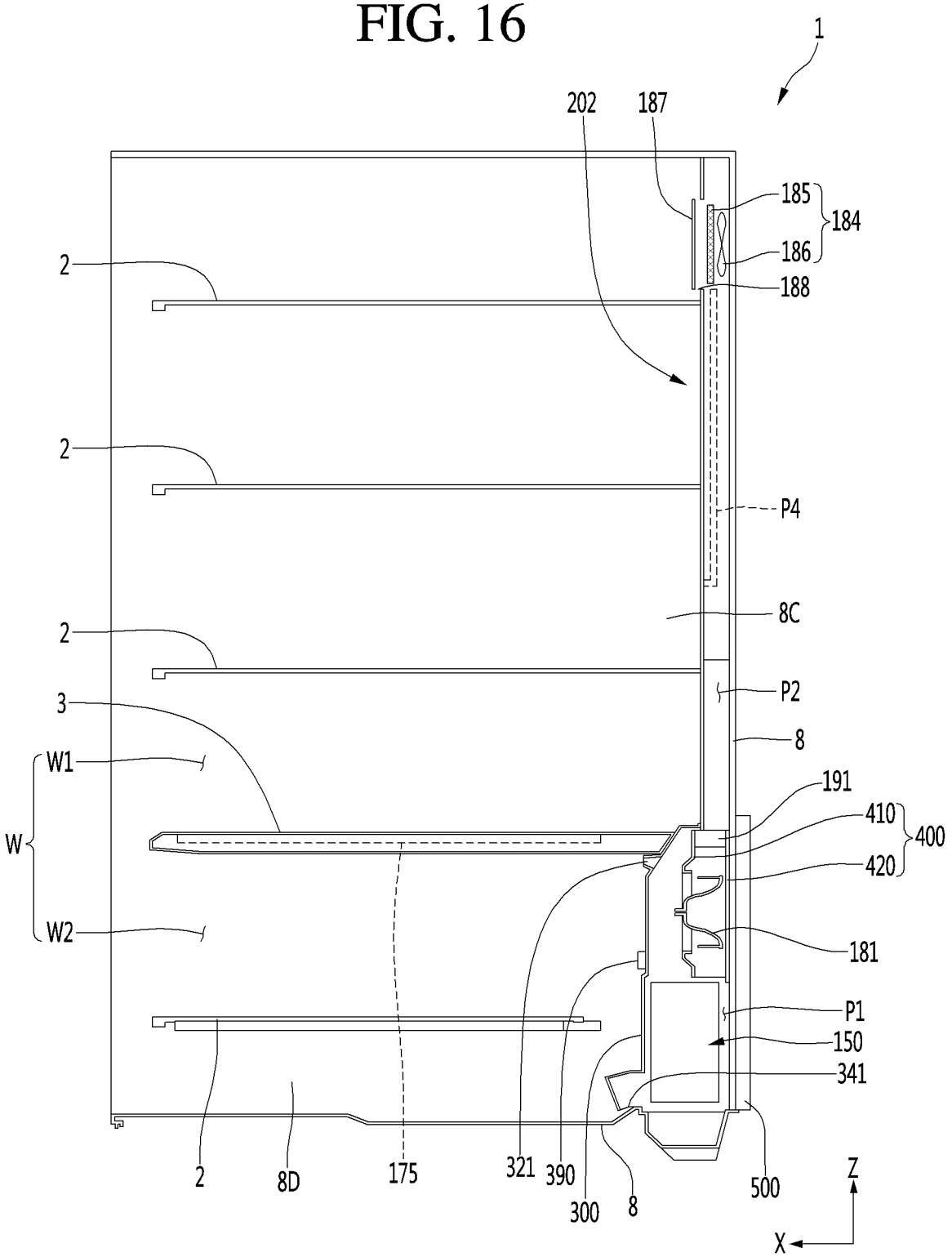
FIG. 16 is a sectional view of a refrigerator according to an embodiment of the present disclosure.

FIG. 14 is a front view illustrating a storage chamber of a refrigerator according to an embodiment of the present disclosure, FIG. 15 is a rear view illustrating an inner portion of an inner guide (or air duct) 20 according to an embodiment of the present disclosure, and FIG. 16 is a sectional view illustrating a refrigerator according to an embodiment of the present disclosure. The inner guide 200 may be disposed in the cabinet 1 in which the first storage chamber W is formed, and may be disposed in the inner case 8 to partition the storage space and the air flow path P.

The air flow path P may be formed between the inner guide 200 and the inner case 8 of the inner space of the inner case 8 or may be formed in the inner guide 200. A temperature adjusting device (or at least one component of a refrigeration system) 150 may be disposed in the air flow path P or may otherwise be connected via an intermediate path or duct to be in fluid communications with the air flow path P.

One example of the temperature adjusting device 150 disposed in the air flow path P may be cooling device capable of cooling the air passing through the air flow path P to cool the storage chamber. The cooling device (hereafter referred to as an evaporator) 150 may be a heat absorbing body of the thermoelectric element, an evaporator through which the refrigerant passes, or the like. Hereinafter, although the temperature adjusting device disposed in the refrigerant flow path P will be described as an example of cooling device, the temperature adjusting device disposed in the air flow path P is not limited to being a cooling device, but may be or include a heating device such as a heater. For convenience, the following description describes an evaporator 150 as an example for the temperature control device disposed in the air flow path P.

At least one fan 181, 186 may be disposed in the inner case 8 or the inner guide 200. The fan 181 may be disposed in the inner guide 200 to circulate air in the storage space to the air flow path P and the storage space. The circulation fan 186 may circulate air in the storage space and may be a heat generation (HG) fan (e.g., a fan to generate a flow of air to a heat generating device). In one example, the fan 181 may be an inner airflow forming mechanism disposed in the air flow path P, and the circulation fan 186 may be an outer airflow forming mechanism disposed outside the air flow path P.

For example, the circulation fan 186 can be disposed in a circulation flow path P4 such that the air of the storage space flows into the circulation flow path P4 that differs from the air flow path P, and the circulation fan 186 blows the air of the circulation flow path P4 into the storage space. The circulation flow path P4 may be formed to be partitioned from the air flow path P, and the circulation flow path P4 may be formed so that the air passing through the circulation flow path P4 is not mixed with the air passing through the air flow path P while passing through the circulation flow path P4. The circulation flow path P4 may be formed in the inner guide 200. The circulation flow path P4 may be formed in communication with the first space W1.

The inner guide 200 may form a storage space together with the inner case 8. For example, when the inner guide 200 is disposed in front of the rear body of the inner case 8, the storage space may be a space in front of the inner guide 200 among the inside of the inner case 8, and the air flow path P may be formed between the inner guide 200 and the rear body of the inner case 8 or may be formed inside the inner guide 200. The inner guide 200 may cover the temperature adjusting device 150 and the fan 181. Hereinafter, the detailed structure of the inner guide 200 is described.

The inner guide 200 may be formed to be spaced apart from the discharge port 204 and the suction (or input) port 205, and in a case where the refrigerator further includes a partition member 3, the partition member 3 may be closer to the lower end of the upper and lower ends of the storage chamber. For example, the discharge port 204 and the suction port 205 may be formed at a position facing the first space W1.

In a case where the discharge port 204 for discharging air into the first space W1 is the first discharge port, the additional discharge port 321 may be a second discharge port, and in a case where the suction port 205 where the air in the first space W1 is suctioned is a first suction port, the additional suction port 341 may be a second suction port.

One surface of the partition member (or partition) 3 may be a suction guide surface for guiding air flowing toward the suction port 205, and the other surface of the partition member 3 may be a discharge guide surface for guiding air discharged to the additional discharge port 321. When the partition member 3 is horizontally disposed in the storage space and the first space W1 is positioned above the second space W2, the discharge port 204 may be an upper discharge port formed at a position higher than the additional discharge port 321 and additional suction port 341, and the additional discharge port 321 may be a lower discharge port. In addition, the suction port 205 may be an upper suction port formed at a position higher than the additional discharge port 321 and the additional suction port 341, and in this case, the additional suction port 341 may be a lower suction port.

In one example, the inner guide 200 may be formed with a heat exchange flow path P1 in which the temperature adjusting device 150 and the fan 181 is received. The inner guide 200 may be formed with a discharge flow path P2 for guiding the air blown by the fan 181 to be discharged to the discharge port 204. The inner guide 200 may be provided with an additional discharge flow path P3 for guiding the air blown by the fan 181 to be discharged to the additional discharge port 321.

The heat exchange flow path P1, the discharge flow path (or first discharge flow path) P2, and the additional discharge flow path (or second discharge flow path) P3 may constitute the air flow path P for guiding air to circulate through the temperature adjusting device 150 and the storage space, and the temperature adjusting device 150 and the fan 181 may be received in the air flow path P to adjust the temperature of the first space W1 and the second space W2.

The air guide 400 may include a front housing 410 and a rear housing 420 in which the fan 181 is received. The air guide 400 may have an outlet 412 communicating with the additional discharge port 321. The outlet 412 may be formed to face the additional discharge port 321 to discharge air to the additional discharge port 321 or may be in communication with the additional discharge port 321 through a discharge duct.

The refrigerator may include a guide 234 that that fluidly connects and guides air forced by the fan 181 inside the air guide 400 to the outlet 412. The guide 234 may be formed in the discharge guide 202 to guide the air blown from the fan 181 to the outlet 412.

The air guide 400 may be provided with a scroll 413 and an opening portion (or opening) 414 that guides air to the discharge flow path P2. The scroll 413 may fluidly connect fan 181 to the opening portion 414 and guide the air blown from the fan 181 to the opening portion 414. In one example, the opening portion 414 may communicate with the lower end of the discharge flow path P2.

The first damper 191 may be disposed in the air flow path P and may adjust the air supplied to the first space W1. In one example, the first damper 191 may be mounted to be positioned between the fan 181 and the discharge port 204 in the air flow direction. For example, the first damper 191 may be provide adjacent to the opening portion 414.

The second damper 192 may be disposed in the air flow path P and may adjust the air supplied to the second space W2. In one example, the second damper 192 may be mounted between the fan 181 and the additional discharge port 321 in the air flow direction.

The circulation fan 186 may be disposed in the inner guide 200. In the inner guide 200, when the circulation fan 186 is operated, a circulation flow path P4 through which air flowing by the circulation fan 186 passes may be formed. When the circulation fan 186 is driven, the inner guide 200 may have an inlet 188 through which air in the storage space flows into the circulation flow path P4. The inner guide 200 may have an outlet 189 through which air from the circulation flow path P4 is discharged into the storage space. The inlet 188 and the outlet 189 may communicate with the first space W1 and may be formed to face the first space W1. The circulation fan 186 may circulate air in the first space W1 into the circulation flow path P4 and the first space W1.

A purifying unit (or air purifier) 185 such as an air purifying filter may be disposed in the circulation flow path P4, and the air passing through the circulation flow path P4 may be purified by the purification unit 185. In another example, the purification unit 185 may included a UV filter to emit radiation that disinfects air.

The inner guide 200 may be provided with a first temperature sensor 190 for sensing the temperature of the first space W1 and a second temperature sensor 390 for sensing the temperature of the second space W2.

The inner guide 200 may further include a discharge guide 202 and an inlet body 187 forming the inlet 188. Along with the discharge guide 202, the inner guide 200 may include an inner cover 300. The discharge guide 202 may be disposed higher than the inner cover 300. The temperature adjusting device 150 and the fan 181 pass through the air flow path P formed by at least one of the discharge guide 202 and the inner cover 300 to supply air to the first space W1 and the second space W2. The temperature adjusting device 150 may be received in the inner cover 300.

The discharge guide 202 and the inner cover 300 may be configured to be received inside the inner case 8 together with the temperature adjusting device 150 and the fan 181. The discharge guide 202, the inner cover 300, and the temperature adjusting device 150 and fan 181 may be minimized in size to reduce the volume occupied in its entirety.

The fan 181 may provide a force to generate a flow of air that is heat exchanged with the temperature adjusting device 150, and the air flowing by the fan 181 can be guided to be discharged at the first space W1 and the second space W2 by the discharge guide 202 and the inner cover 300. The discharge guide 202 may face the first space W1, and the discharge guide 202 may be formed with the discharge port 204 and the suction port 205.

The inner cover 300 may be connected to the discharge guide 202. The inner cover 300 may face the second space W2, and the inner cover 300 may be formed with the additional discharge port 321 and the additional suction port 341. For example, one surface of the discharge guide 202 may face the first space W1, and the discharge port 204 and the suction port 205 may be formed in an area of the discharge guide 202 facing the first space W1.

The heating air generation (HG) module 184 that purifies the air in the first space W1 and the first temperature sensor for sensing the temperature of the first space W1 may be provided in a portion of the discharge guide 202 facing the first space W1. The HG module 184 may include a circulation fan 186. The HG module 184 may include a purifying unit 185, such as an air purifying filter.

In the heating mode of the storage space, the refrigerator may perform a heat generate (HG) care mode which can accelerate the heating of the storage space by using the HG module 184. In the heating mode of the first space W1, the HG care mode may be a mode which allows air in the first space W1 to be circulated into the heating device 171 and the circulation flow path P4 by driving circulation fan 186 and thus accelerates the heating of the first space W1. In one example, the HG care mode may include the air heat-exchanged with the temperature adjusting device 150 not being supplied to the first space W1 in the heating mode of the first space W1. In the HG care mode, the refrigerator may close the first damper 191, stop the fan 181, or otherwise prevent the refrigerant from being circulated to the temperature adjusting device 150.

The refrigerator may drive the fan 181 for the cooling mode of the second space W2 when the first space W1 is the heating mode and the second space W2 is the cooling mode and may allow the refrigerant to be circulated. For example, in the HG care mode, the refrigerator can close the first damper 191 and open the second damper 192.

The circulation fan 186 may be installed for a heating mode of any one of the first space W1 and the second space W2 which has a larger volume. For example, if the volume of the first space W1 is larger than the volume of the second space W2, the circulation fan 186 may be installed to flow air in the first space W1 to the heating device 171. In another example, the circulation fan 186 may be installed for the heating mode of any one of first space W1 and the second space W2 in which more heating mode is performed and may be installed so as to flow air in any one of first space W1 and the second space W2 in which the target temperature range is higher to the heating device 171. The target temperature range of the first space W1 may be higher than the target temperature range of the second space W2. In this case, the circulation fan 186 may be installed to flow air in the first space W1 to the heating device 171. In one example, the circulation fan 186 may be operated from the start of the heating mode of the first space W1 and may be operated in the middle of the heating mode.

One surface of the inner cover 300 may face the second space W2, and the additional discharge port 321 and the additional suction port 341 may be formed in an area of the inner cover 300 facing the second space W2. The height of the additional discharge port 321 may be higher than the height of the additional suction port 341. The additional discharge port 321 may be formed on the inner cover 300, and the air blown by the fan 181 may be discharged into the second space W2 through the additional discharge ports 321. An additional suction port 341 may be formed below the inner cover 300. The air suctioned into the additional suction port 341 may flow to the temperature adjusting device 150.

As previously described, a portion of the inner cover 300 facing the second space W2 may be provided with a second temperature sensor 390. The second temperature sensor 390 may sense the temperature within the second space W2.

In one example, the refrigerator may include at least one heating device that heats the storage space, and the refrigerator may perform the heating mode H (see FIG. 4) using the heating device. At least one heating device may be operated independently from the temperature adjusting device 150 disposed in the air flow path P. As previously described, the refrigerator may perform the cooling mode E (see FIG. 4) by the temperature adjusting device 150 disposed in the air flow path P, and may perform the heating mode H using the at least one heating device.

The heating device may include first heating device 171, 172 capable of heating the storage chamber by conduction and radiation, and the second heating device (or heating module) 184 capable of heating the storage chamber by convection. The first heating device may be disposed to heat only one of the first space W1 and the second space W2 and may be provided for each of the first space W1 and the second space W2. In consideration of energy efficiency or the like, the first heating device may be installed at a position that is thermally separated from the temperature adjusting device disposed in the air flow path P. For example, the first heating device may be disposed in addition to the air flow path P. The first heating device may be disposed in addition to the inner guide forming the air flow path P. The first heating device may be disposed other than a surface of the inner case that directly faces the inner guide (for example, when the inner guide is disposed behind the storage chamber, the surface of the inner case that faces the inner guide and forms the rear of the storage chamber).

In some examples, the first heating device 171 may be disposed to heat the region of the first space W1 relatively easy to allow supercool of other regions. For example, air discharged from the discharge ports 204 and 321 into the storage chamber space may fall and be suctioned through the suction ports 205 and 341, and an area close to the suction ports 205 and 341 in the storage space may be an area which is relatively and easily supercooled down than an area far from the suction ports 205 and 341. The first heating device may be disposed to heat more of the storage space adjacent to the suction port than the storage space adjacent to the discharge port. For example, the heating device 171 for the first space W1 may be disposed below the inner case forming the first partition member 3 and the first space. For example, the heating device 172 for the second space W2 may be disposed in an inner case forming a second space with the second partition member 10. The heating device 172 for the second space W2 may be installed in an inner case positioned between the first partition member 3 and the second partition member 10.

In some examples, the second heating device 184 may be installed as far as possible from the first heating device (171, 172) in order to increase the circulation efficiency by convection. For example, the second heating device 184 may be disposed closer to the discharge ports 204 and 321 than to the suction ports 205 and 341. The first heating device 171, 172 may be located below the storage chamber, and the second heating device 184 may be located above the storage chamber. The second heating device 184 may be located above the partition wall 3, and the cooling device 150 may be located below the partition wall 3. The second heating device 184 may be located above the inner guide 200, and the cooling device 150 may be located below the inner guide 200. The circulation flow path P4 for the second heating device 184 formed in the inner guide 200 and the air flow path P for the cooling device 150 may be partitioned by a heat insulating body.

The heating device 171 may include a pair of first side heating devices 173 and 174 disposed on the first body 8C. The heating device 171 may include an inner heating device 175 disposed on the partition member 3 or the shelf 2. The inner heating device 175 is disposed to be exposed to an outer surface of the partition member 3, the shelf 3 or the heating body to directly heat the air in the storage space.

The refrigerator may further include an additional heating device 172 for heating the second space W2. The additional heating device 172 may include a pair of second side heating devices 176 and 177 disposed on the second body 8D. The additional heating device 172 may further comprise a lower heating device 178 disposed on the lower body of the inner case 8.

In the cooling mode of the first space W1, the cooling device and the fan 181 may be operated, and the heating device 171 may be stopped. In the heating mode of the first space W1, the heating device 171 may be operated. In the heating mode of the first space W1, the circulation fan 186 is driven so that the air in the first space W1 circulates through the heating device 171 and the circulation flow path P4, and the first space W1 can be heated by convection. In this case, the cooling device may be controlled so that the air of the air flow path P is not discharged into the first space W1, and thus the first damper 191 may be closed or the fan 181 may be stopped.

In the heating mode of the second space W2, the fan 181 may be operated so that the air in the first space W1 circulates through the heating device 171 and the air flow path P, and the first space W1 can be heated by convection. In this case, the cooling device may control the flow path switching mechanism 120, 120' and the compressor 100 such that the refrigerant is not supplied to the temperature adjusting device 150. In the cooling mode of the second space W2, the cooling device and the fan 181 may be operated, and the additional heating device 172 may be stopped.

In the heating mode of the second space W2, the additional heating device 172 may be operated. In this case, the fan 181 may be activated or stopped. For example, in the heating mode of the second space W2, the fan 181 is operated so that the air in the second space W2 circulates through the additional heating device 172 and the air flow path P, and the second space W2 can be heated by convection. In this case, the cooling device may control the flow path switching mechanism 120, 120' and the compressor 100 such that the refrigerant is not supplied to the temperature adjusting device 150. In another example, in the heating mode of the second space W2, the fan 181 may be stopped, and in this case, the additional heating device 172 may heat the second space W2 by conduction.

The controller 30 may turn on/off the circulation fan 186 at a predetermined cycle during the operation of the circulation fan 186. For example, the controller 30 may repeat a ten minute cycle in which the controller 30 turns on the circulation fan 186 for three minutes and then turns off the circulation fan 186 for seven minutes.

As the temperature change inside the storage chamber increases, there is a case where the quality of the goods stored in the storage chamber may decrease. The temperature change amount in the storage chamber can be considered in two aspects. First, it is possible to measure the temperature change amount over time (hereinafter, referred to as time-temperature change amount) based on a specific point of the storage space. For example, the time-temperature change amount may correspond to a difference value between the first temperature of the upper space of the storage chamber at the first time and the second temperature of the upper space of the storage chamber at the second time different from the first time.

Second, the temperature change amount according to the location of the storage space (hereinafter, the space-temperature change amount) can be measured at the substantially same time. For example, the space-temperature change amount may correspond to a difference value between the first temperature of the upper space of the storage chamber and the second temperature of the lower space of the storage chamber at the same time.

As a method for reducing the space-temperature change amount of the storage chamber, it is possible to extend the air flow path P to a point where the temperature distribution is weak. For example, an air flow path for delivering cold air to the front portion of the door in which the door basket is installed may be installed in the space between the side body of the inner case and the side body of the outer case. In this case, an additional air flow path may be provided between the inner case and the outer case, which may cause an increase in a thickness of the side heat-insulating wall of the refrigerator. Since the refrigerator of the present disclosure is a columnar refrigerator having a length longer than that of the width, the resulting loss of the internal storage space from the additional air flow path may be large. In one example, in a case where the cooling device and the air flow path for the cooling device are disposed behind the rear body of the inner case, if the heating device and the air flow path for the heating device are substantially identically disposed behind the rear body of the inner case, the various components may be disposed in an overlapping manner and, thus, the storage chamber space may be reduced. Furthermore, the cooling device and the heating device may be disposed adjacent to each other, and these devices may counter each other such that power consumption may be increased.

In order to reduce the storage chamber space and increase the power consumption in this way, the air flow path for the heating device is disposed together with the air flow path for the cooling device in the rear of the rear body of the inner case in a state of being partitioned to be heat-insulated, and the heating device is preferably disposed at a position other than the rear body of the inner case (for example, at least one of the side body and the bottom body of the inner case, and partition walls 3 and 10). Since cold air accumulates below the storage chamber, the heating device may be positioned so as to heat the lower portion of the storage chamber more to reduce the space-temperature change amount. When more heating device are disposed below the storage chamber, the air flow path and the circulation fan 186 for the heating device may be positioned on the storage chamber so as to reduce the space-temperature change amount, and thus the air circulation efficiency may be increased. In one example, when both the heating device and the circulation fan for the heating device are located below the storage chamber, the upper side of the storage chamber may not be sufficiently heated without using a circulation fan that moves a relatively large air volume. Using a circulation fan with a large air volume may be disadvantageous in terms of noise and power consumption. In addition, when the cooling device and the air flow path for the cooling device are disposed to be more efficiently distributed below the storage chamber, the air flow path for the heating device can be disposed above the storage chamber to minimize the reduction in the storage chamber space.

Since the circulation fan 186 may be installed to reduce the space-temperature change amount, the air volume of the circulation fan 186 may be controlled to be increased as the space-temperature change amount of the storage chamber increases. For example, when temperature sensors are present in the upper portion of the first space W1 and the lower portion of the first space W1, respectively, the air volume moved by the circulation fan 186 can be controlled to increase (e.g., by increasing a rotational speed of the circulation fan 186) as the upper temperature sensor and lower temperature sensor measurement values increase. As another example, as the difference between the target temperature for the first space W1 and the target temperature for the second space W2 is increased, the air volume of the circulation fan 186 can be controlled to increase. As another example, when the heating device starts operating in the heating mode, when the temperature of the storage chamber reaches the lower limit temperature, the air volume of the circulation fan 186 can be controlled to be greater than the air volume of the circulation fan 186 when the temperature of the storage chamber reaches the target temperature lower limit value.

Alternatively, the controller 30 may control the output of the circulation fan 186 differently according to the temperature of the first space W1 and the temperature of the second space W2. One example of differentiating the output of the circulation fan 186 may be different from the on time of the circulation fan 186 when the circulation fan 186 is periodically turned on and off. Another example of making the output of the circulation fan 186 different may be that the wind speed of the circulation fan 186 is different.

Thus, in certain examples, the controller 30 may control the circulation fan 186 such that the circulation fan on time and the circulation fan off time are different according to the temperature of the first space W1 and the temperature of the second space W2. When the difference between the temperature of the first space W1 and the temperature of the second space W2 is large, the controller 30 can lengthen the circulation fan on time and shorten the circulation fan off time.

In certain examples, when the difference between the temperature of the first space W1 and the temperature of the second space W2 is small, the controller 30 can shorten the circulation fan on time and lengthen the circulation fan off time. Similarly, when the difference between the target temperature of the first space W1 and the target temperature of the second space W2 is large, the controller 30 can lengthen the circulation fan on time and shorten the circulation fan off time. When the difference between the target temperature of the first space W1 and the target temperature of the second space W2 is small, the controller 30 may shorten the circulation fan on time and increase the circulation fan off time.

Table 1 illustrates an example of the circulation fan On time and the circulation fan Off time according to the target temperature of the first space W1 and the target temperature of the second space W2.

TABLE 1

| | First space target temperature 12° C. to 13° C. | First space target temperature 13° C. to 16° C. | First space target temperature 17° C. to 18° C. |
|---|---|---|---|
| Second space target temperature 6° C. to 7° C. | J | I | I |
| Second space target temperature 8° C. to 9° C. | K | J | I |
| Second space target temperature 10° C. to 11° C. | K | K | J |

In Table 1, Entry I corresponds to a circulation fan On time of 3 minutes and a circulation fan Off time of 7 minutes; Entry J may have a circulation fan On time of 2 minutes and a circulation fan Off time of 8 minutes; and Entry K may have a circulation fan On time of 1 minute and a circulation fan Off time of 9 minutes.

The circulation fan on time (for example, 3 minutes) in a case where the difference between the target temperature of the first space W1 and the target temperature of the second space W2 is large (e.g., entry I in Table 1) may be longer than the circulation fan On time (for example, 2 minutes or 1 minute) in a case where the difference is small (entries J or K in Table 1). In another example, the circulation fan Off time (for example, 7 minutes) when the difference between the target temperature of the first space W1 and the target temperature of the second space W2 is large (e.g., entry I in Table 1) may be shorter than the circulation fan Off time (for example, 8 minutes or 9 minutes) in a case where the difference is small (e.g., entries J or K in Table 1).

As one example in which the first space W1 is the heating mode, the second space W2 is a standby mode, the heating device 171 may be operated, the compressor 100 is not operated or the flow path switching mechanism 120, 120' does not guide the refrigerant to the temperature adjusting device 150, the first damper 191 and the second damper 192 may be closed, and the circulation fan 186 may be operated. In this combination of conditions, the circulation fan 186 may be operated such that the air in the first space W1 may be heated by convection while circulating the heating device 171 and the circulation flow path P4.

As another example in which the first space W1 is the heating mode, the second space W2 is a standby mode, the heating device 171 may be operated, the compressor 100 is not operated or the flow path switching mechanism 120, 120' does not guide the refrigerant to the temperature adjusting device 150, the first damper 191 may be opened, the second damper 192 may be closed, and the circulation fan 186 may be operated. In this combination of conditions, operation of the circulation fan 186 may cause the air in the first space W1 to circulate through the heating device 171 and the air flow path P, thereby allowing the first space W1 to be heated by convection.

In another example, when the difference between the target temperature of the first space W1 and the target temperature of the second space W2 is relatively small (e.g., less than a threshold difference), the controller 30 may shorten the circulation fan on time and lengthen the circulation fan off time. In another example, the controller 30 may control the circulation fan 186 such that the wind speed of the circulation fan is different according to the temperature of the first space W1 and the temperature of the second space W2.

For example, the controller 30 may manage the circulation fan wind speed, when the difference between the target temperature of the first space W1 and the target temperature of the second space W2 is relatively large (e.g., more than a threshold difference), to be larger than the circulation fan wind speed when a difference between the target temperature of the first space W1 and the target temperature of the second space W2 is small. In another example, the controller 30 may set the circulation fan wind speed to the first wind speed when the difference between the target temperature of the first space W1 and the target temperature of the second space W2 is relatively large, and may set the circulation fan wind speed, when the difference between the target temperature of the first space W1 and the target temperature of the second space W2 is relatively small, to the second wind speed that is lower than the first wind speed.

In another example, the circulation fan 186 may be operated according to the cleanliness of the storage space or may be operated at a predetermined period (for example, one hour), and the control of the circulation fan 186 may be defined as a general mode to distinguish it from the HG care mode. For example, when the condition of the normal mode and the condition of the HG care mode are both satisfied, the controller 30 may give priority to the HG care mode over the general mode without executing the general mode.

In some examples, the controller 30 may selectively execute the plurality of modes E, H, and D according to the input device, the timer 37, and the temperature sensors 190 and 390. For example, the controller 30 can adjust the temperature of the first space W1 in the cooling mode or the heating mode or maintain the temperature of the first space W1 in the standby mode according to the target temperature of the first space W1 input through the input device, the temperature detected by the first temperature sensor 190, and the time counted by the timer 37.

In another example, the controller 30 may control the second space W2 in a cooling mode, a standby mode, and a heating mode. The controller 30 can adjust the temperature of the second space W2 in the cooling mode or the heating mode or maintain the temperature of the second space W2 in the standby mode according to the target temperature of the second space W2 input through the input device, the temperature detected by the second temperature sensor 390, and the time counted by the timer 37.

Hereinafter, in order to avoid overlapping descriptions, a space that is temperature-adjusted by the cooling device and the heating device will be described as a storage chamber W; the temperature of the storage chamber W will be described as being sensed by the temperature sensor 190; the fan 181 and the circulation fan 186 will be described as an example of the air flow forming mechanism for flowing the air in the storage chamber; the temperature adjusting device 150 is described as a configuration of the cooling device; and the heating device 171 is described as heating the storage chamber.

Hereinafter, the switching between the cooling mode by the cooling device and the heating mode by the heating device will be described in detail with reference to FIGS. 4, 17 and 18. As described above, the temperature change amount of the storage chamber may include a time-temperature change amount, and a space-temperature change amount.

As a method for reducing the time-temperature change amount in the storage chamber, it is possible to set the target temperature ranges so as to reduce the difference between the target temperature upper limit value and the target temperature lower limit value (hereinafter, referred to as storage temperature difference). In this case, due to the frequent on/off of the temperature adjusting device as the temperature in the storage chamber is outside the target temperature upper or lower limit value, there may be disadvantages that the reliability of the components may be reduced and the power consumption may increase.

In another method, the above problem that reducing the storage temperature difference may cause the reliability of the components to be reduced and the power consumption to be increased can be reduced by using a temperature adjusting device including separate cooling device and heating device. For example, the cooling device and the heating device may be provided to control the temperature of at least one of the expensive specific goods storage chamber, the constant temperature chamber, or the priority storage chamber of the refrigerator. If, for example, at least some of the heating devices are temporarily disabled/malfunctioned, the target temperature of the storage chamber is controlled to be increased (or decreased), or the door is opened, resulting in an excessive inflow of outside air that is lower (or higher) than the inside of the refrigerator, the temperature of the storage chamber can be supercooled (or overheated). As a result, the heating device (or cooling device) may be operated to improve or maintain the quality of the stored product.

Furthermore, since the cooling device and the heating device perform opposite functions in terms of maintaining the storage chamber temperature, the cooling device and the heating device may be separated/partitioned by insulation in order to reduce power consumption, and in terms of control, the operation of the cooling device and the heating device may be controlled so as not to overlap each other (e.g., to operate concurrently). For this purpose, the cooling device and the heating device may be controlled to operate alternatively.

Furthermore, when the operation starting condition of the predetermined heating device is satisfied after the cooling device is ended, the controller 30 may implement a delay rather than immediately start the operation of the heating device. For example, when the door is opened frequently for a short time such that the temperature of the storage chamber changes suddenly, operating the temperature adjusting device immediately may cause disadvantages that the component reliability is reduced and power consumption is increased due to the frequent on/off of the temperature adjusting device. Meanwhile, it may be very difficult to set this time difference fixedly because it is almost impossible to set the time difference uniformly since the situation in which the switching between the cooling device and the heating device should occur is very diverse. Therefore, the greater the difference between the temperature of the storage chamber and the target temperature of the storage chamber, the greater the likelihood of deterioration of the stored product, and therefore, the time difference is preferably set shorter.

For example, if the heating device is operated, for example, when the temperature of the storage chamber reaches the target temperature lower limit value (T4° C.), the heating device may be operated after the first time T1 has elapsed, and when the temperature of the storage chamber reaches the temperature (T5° C.) lower than the target temperature lower limit value (T4° C.), it may be preferable to allow the heating device to operate after the second time (T2, T2<T1) has elapsed. Additionally, when the temperature of the storage chamber reaches a temperature (T6° C.)

lower than the temperature (T5° C.), it may be able to operate the heating device after the third time (T3, T3<T2) has elapsed.

Figure 17:
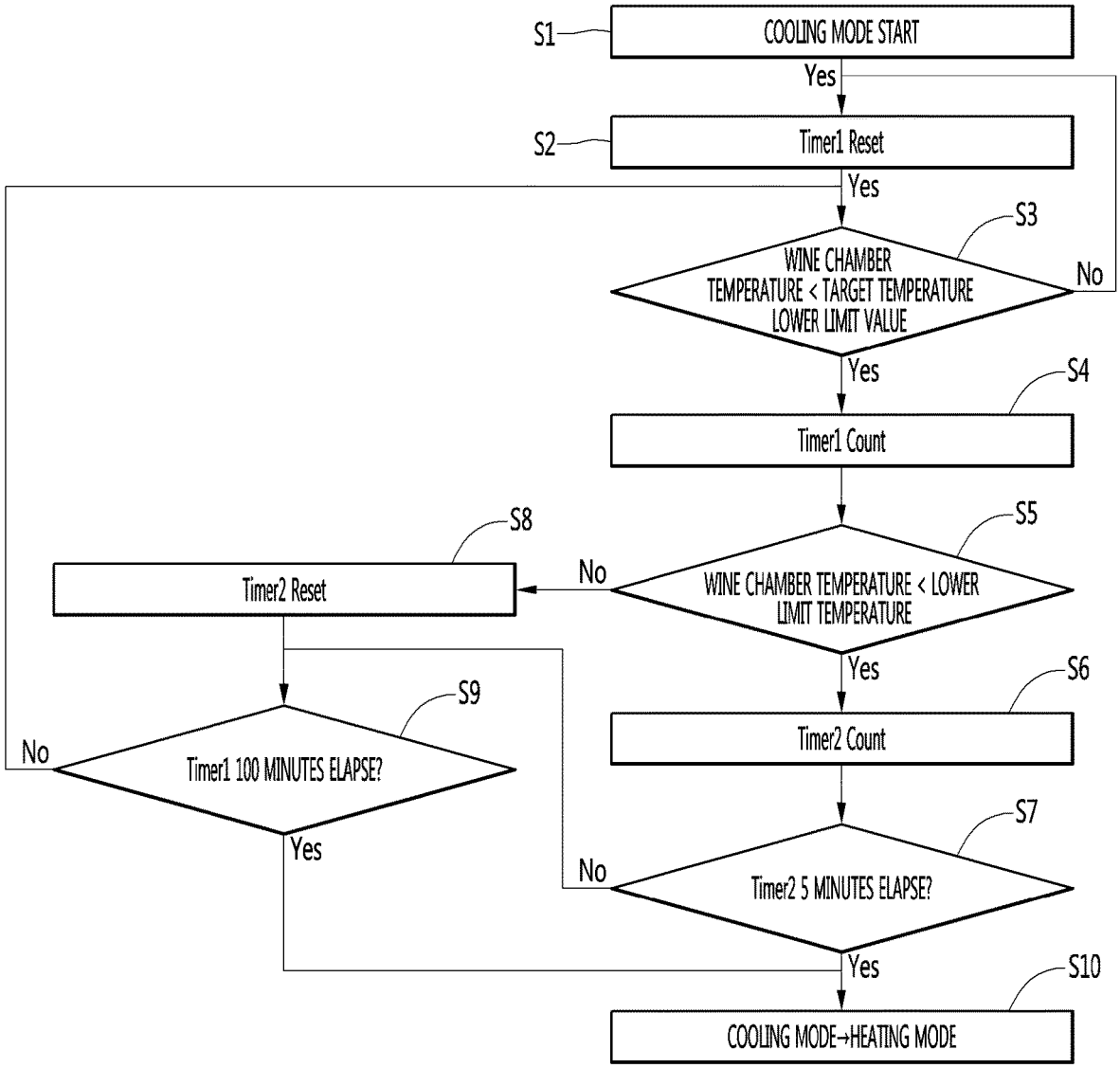
FIG. 17 is a flow chart when the refrigerator is switched to the heating mode from the cooling mode according to an embodiment of the present disclosure.

FIG. 17 is a flow chart when the refrigerator is switched from the cooling mode to the heating mode according to an embodiment of the present disclosure. If power is applied to the refrigerator, the controller 30 may compare the storage chamber temperature sensed by the temperature sensor 190 (hereinafter, referred to as a storage chamber temperature) with an upper limit value of the target temperature, and if the storage chamber temperature is higher than the upper limit value of the target temperature the controller 30 can start the cooling mode E (S1).

The controller 30 may reset the first timer of the timer 37 when the cooling mode E starts. In the present discussion, the first timer may be distinguished from a second timer, to be described later. The timer 37 may include the first timer and the second timer. A start time at which the first timer starts counting time and a start time at which the second timer starts counting time may be different from each other.

The controller 30 may operate the temperature adjusting device 150 in the cooling mode E and operate the fan 181. Here, the operation of the temperature adjusting device 150 may include, for example, operating the refrigerator to supply the refrigerant to the temperature adjusting device 150, operating the compressor 100, and/or operating the flow path switching mechanism 120, 120' to guide the refrigerant to the temperature adjusting device 150. The air in the storage chamber W may cool the storage chamber W while circulating between the storage chamber W and the temperature adjusting device 150, and the storage chamber temperature may be gradually lowered by operation of the temperature adjusting device 150.

The controller 30 may stop the temperature adjusting device 150 if the storage chamber temperature is less than the lower limit value of the target temperature. The stopping of the temperature adjusting device 150 may include, for example, operating the refrigerator so that the refrigerant is not supplied to the temperature adjusting device 150, stopping the compressor 100, and/or operating the flow path switching mechanism 120, 120' to not supply the refrigerant to the temperature adjusting device 150.

When the temperature adjusting device 150 is stopped, the storage chamber temperature may be increased again above the target temperature lower limit value or maintained between the target temperature lower limit value and the lower limit temperature, or lower than the lower limit temperature according to the load.

The controller 30 may count, using the first timer of the timer 37, when the storage chamber temperature is less than the lower limit value of the target temperature (S3)(S4). The timer 37 may be used to count the times for which the storage chamber temperature maintains a temperature less than the lower limit value of the target temperature. The refrigerator may count a time (hereinafter, referred to as first time) when the storage chamber temperature is less than the lower limit value of the target temperature using the timer 37.

The controller 30 may compare the storage chamber temperature with the lower limit temperature, and reset a second timer of the timer 37 if the storage chamber temperature is equal to or higher than the lower limit temperature (S5)(S8). For example, the controller 30 can compare the first time counted by the timer 37 with the first set time (for example, 100 minutes), and the controller 30 can start if the first time counted by the timer 37 (e.g., a time interval between the storage chamber temperature being less than the lower limit value of the target temperature) is higher than the first set time (for example, 100 minutes) (S9)(S10).

Meanwhile, the controller 30 may not start the heating mode H and can compare again the storage chamber temperature with the target temperature lower limit value if the first time is equal to or less than the first set time (for example, 100 minutes), as a result of the comparison of the first time with the first set time (for example, 100 minutes). In addition, the controller 30 may reset the first timer of the timer if the storage chamber temperature is equal to or higher than the target temperature lower limit value (S3)(S2).

If the storage chamber temperature is less than the lower limit value of the target temperature and less than the lower limit temperature, the controller 30 may count the second timer of the timer 37 (S3)(S5)(S6). Here, the counting of the second timer may mean that the timer 37 counts the time for which the storage chamber temperature is maintained below the lower limit temperature. Thus, the refrigerator may count a time (hereinafter, referred to as a second time) for which the storage chamber temperature is less than the lower limit temperature using the timer 37. The controller 30 may then start the heating mode H if the second time is greater than the second set time as a result of the comparison of the second time with the second set time (for example, 5 minutes) (S7)(S10).

The controller 30 may compare the first time with the first set time if the second time is equal to or less than the second set time, and may start the heating mode H if the first time is greater than the first set time (S7)(S9)(S10). If the second time is equal to or less than the second set time, and the first time is equal to or less than the first set time, the controller 30 may not start the heating mode H and may compare the storage chamber temperature and the lower limit value of the target temperature (S7)(S9)(S3). For example, after the end of the cooling mode E, if the time for which the storage chamber temperature maintains between the target temperature lower limit value and the lower limit temperature is higher than the first set time (for example, 100 minutes) or the time for which the storage chamber temperature maintains a temperature less than the lower limit temperature is greater than the second set time (for example, 5 minutes), the refrigerator can start the heating mode H.

In certain implementations, the refrigerator may be in a standby mode D during a first set time for which the storage chamber temperature maintains the target temperature lower limit value and a lower limit temperature, and the refrigerator may be in standby mode D during a second set time for which the storage chamber temperature maintains the lower temperature.

Upon start of the heating mode H, the controller 30 may operate the heating device 171, may operate the circulation fan 186 and/or the fan 181, and the temperature of the storage chamber may be gradually raised by the operation of the heating device 171 and the operation of the circulation fan 186 and/or the fan 181.

Figure 18:
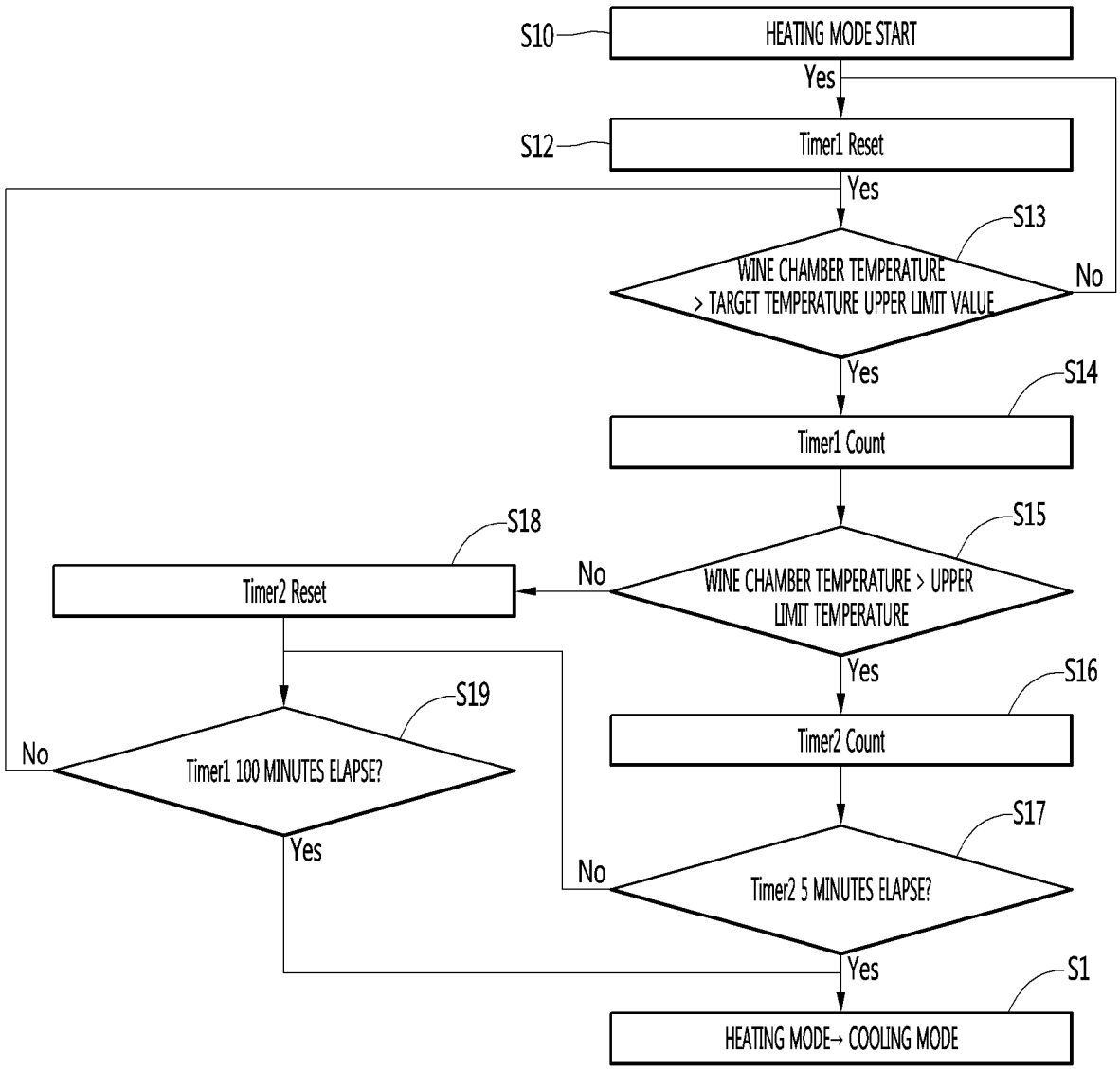
FIG. 18 is a flowchart when the refrigerator is switched from the heating mode to the cooling mode according to an embodiment of the present disclosure.

FIG. 18 is a flowchart when the refrigerator is switched from the heating mode to the cooling mode according to an embodiment of the present disclosure. For example, the controller 30 may reset the first timer of the timer 37 at the start of the heating mode H (S12). The first timer may be distinguished from the second timer. The timer 37 may include a first timer and a second timer. A start time at which the first timer starts counting time and a start time at which the second timer starts counting time may be different from each other, as described below.

The controller 30 may operate the heating device 171 in the heating mode H and may operate the circulation fan 186 and/or the fan 181 to distribute heat. The operation of the heating device 171 may mean, for example, that the temperature of the heating device 171 is raised so that the heating device 171 raises the ambient temperature based on, for example, the operation (e.g., activation) of the heater. The air in the storage chamber W may heat the storage chamber W while circulating between the storage chamber W and the heating device 171, and the storage chamber temperature may be gradually increased by operation of the heating device 171.

The controller 30 may stop the heating device 171 if the storage chamber temperature is higher than the upper limit value of the target temperature. Stopping the heating device 171 may include, for example, cutting off the current applied to the heating device 171 to stop (e.g., turn off) of the heater.

If the heating device 171 is stopped, the storage chamber temperature may increase again below the target temperature upper limit value, maintain between the target temperature upper limit value and the upper limit temperature, or be lower than the upper limit temperature, according to the load. The controller 30 may count the first timer of the timer 37 if the storage chamber temperature is higher than the upper limit value of the target temperature (S13)(S14). Here, the counting with the first timer may mean that the timer 37 counts the time for which the storage chamber temperature maintains a temperature which is higher than the upper limit value of the target temperature. The refrigerator may count a time (hereinafter, referred to as first time) for which the storage chamber temperature is higher than the upper limit value of the target temperature by using the timer 37.

The controller 30 may compare the storage chamber temperature with the upper limit temperature and reset the second timer of the timer 37 if the storage chamber temperature is higher than the upper limit temperature (S15)(S18). In addition, the controller 30 can compare the first time counted by the timer 37 with the first set time (for example, 100 minutes), and the controller 30 can start the cooling mode E if the first time counted by the timer 37 is higher than the first set time (for example, more than 100 minutes) (S19)(S1). On the other hand, the controller 30 may not start the cooling mode E and may compare again the storage chamber temperature with the target temperature upper limit value if the first time is equal to or less than the first set time (for example, less than 100 minutes) as a result of the comparison of the first time with the first set time (S19)(S13). The controller 30 may reset the first timer of the timer if the storage chamber temperature is equal to or less than the target temperature upper limit value (S13)(S12).

In addition, the controller 30 may count the second timer of the timer 37 if the storage chamber temperature is higher than the upper limit value of the target temperature and lower than the upper limit temperature (S13)(S15)(S16). The counting of the second timer may mean that the timer 37 counts the time for which the storage chamber temperature maintains above the upper limit temperature. Accordingly, the refrigerator may count a time (hereinafter, referred to as a second time) for which the storage chamber temperature is higher than the upper limit temperature using the timer 37.

The controller 30 may start the cooling mode E if the second time is greater than the second set time (for example, 5 minutes) as a result of the comparison of the second time with the second set time (S17) (S1). The controller 30 may compare the first time with the first set time if the second time is equal to or less than the second set time, and start the cooling mode E if the first time is greater than the first set time (S17)(S19)(S1).

If the second time is equal to or less than the second set time and the first time is equal to or less than the first set time, the controller 30 does not start the cooling mode E and can compare the storage chamber temperature with the target temperature upper limit value (S17)(S19)(S13). For example, in the refrigerator, after the end of the heating mode H, the refrigerator can start the cooling mode E if the time for which the storage chamber temperature maintains between the upper limit value of the target temperature and the upper limit temperature is greater than the first set time (for example, 100 minutes) or the storage chamber temperature maintains a temperature which is higher than the upper limit temperature.

In addition, the refrigerator may be in the standby mode D during a first set time for which the storage chamber temperature maintains between the upper limit value of the target temperature and the upper limit temperature, and in the standby mode (D) during the second set time for which the storage chamber temperature maintains a temperature which is higher than the upper limit temperature.

An aspect of the present disclosure provides a refrigerator that can minimize the deterioration of the quality of the goods stored in the storage chamber. Another aspect of the present disclosure is to provide a refrigerator capable of controlling the temperature of the storage chamber to a higher temperature range than a conventional refrigerating chamber, and minimizing the supercooling of the storage chamber or overheating of the storage chamber.

A refrigerator according to an embodiment of the present disclosure may include a cabinet configured to have an inner case in which a storage chamber is formed, a cooler configured to cool the storage chamber, heating device configured to be spaced apart from the cooler and heat the storage chamber, a circulation fan configured to circulate air in the storage chamber, and a controller configured to operate the circulation fan when the heating device is operated.

The refrigerator may further include an inner guide configured to be disposed in the inner case and partition the storage chamber into a storage space and an air flow path. The cooler may be disposed in the air flow path. The heating device may be disposed in at least one of an inner portion of the storage space and the inner case.

The refrigerator may further include a fan configured to be disposed in the cold air flow path. The heating device may be disposed in a side body of the inner case facing the storage space. The refrigerator may further include a partition member configured to partition the storage space into a first space and a second space. The heating device may be disposed to the partition member.

The inner guide may include a circulation flow path which communicates with the first space and which is partitioned from the air flow path. The circulation fan may be disposed in the circulation flow path. The refrigerator may further include a purifying unit configured to be disposed in the circulation flow path. The controller may operate the heating device and the circulation fan in the heating mode of the first space. The controller may operate the cooler and the fan in the cooling mode of the first space. The controller may operate the heating device, the circulation fan, the cooler, and the fan if the first space is a heating mode and the second space is a cooling mode.

The refrigerator may further include a first damper configured to adjust air supplying into the first space, and a second damper configured to adjust air supplying into the second space. The controller may close the first damper and open the second damper if the first space is a heating mode and the second space is a cooling mode.

The controller may turn on the circulation fan during the circulation fan on time, and then turn off during the circulation fan off time, and repeat turn-on and turn-off of the circulation fan. A circulation fan on time in a case where the difference between the target temperature of the first space and the target temperature of the second space is large may be longer than the circulation fan on time in a case where the difference therebetween is small. The circulation fan off time in a case where the difference between the target temperature of the first space and the target temperature of the second space is large may be shorter than the circulation fan off time in a case where the difference therebetween is small. The circulation fan wind speed in a case where the difference between the target temperature of the first space and the target temperature of the second space may be large is larger than the circulation fan wind speed in a case where the difference therebetween is small.

According to an embodiment of the present disclosure, the storage chamber may be more quickly heated in a convection manner by using a circulation fan, and thus it is possible to minimize temperature variations in the storage chamber. In addition, while the second space is cooled, the first space may be heated independently of the second space to adjust the temperature of each of the first space and the second space to an optimum temperature range, the temperature gradient of the first space is minimized, and thus it is possible to minimize the deterioration of the quality of some goods in the first space. In addition, since the air in the first space is heated while circulating the heating device and the circulation flow path without passing through the air flow path in which the cooling device is disposed, the first space can be heated more quickly, and the energy efficiency is high.

This application is also related to U.S. application Ser. No. 16/725,428 filed , U.S. application Ser. No. 16/725,436 filed , U.S. application Ser. No. 16/725,092 filed , U.S. application Ser. No. 16/725,271 filed , U.S. application Ser. No. 16/725,166 filed , and U.S. application Ser. No. 16/725,071 filed the entire contents of which are hereby incorporated by reference.

The above description is merely illustrative of the technical idea of the present disclosure, and a person skilled in the art to which the present disclosure pertains may make various modifications and changes without departing from the essential characteristics of the present disclosure. Therefore, the embodiments disclosed in the present disclosure are not intended to limit the technical idea of the present disclosure but to describe the present disclosure, and the scope of the technical idea of the present disclosure is not limited by these embodiments. The protection scope of the present disclosure should be interpreted by the following claims, and all technical ideas within the scope equivalent thereto should be construed as being included in the scope of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having an inner case in which a storage chamber is formed;

a partition wall configured to partition an interior of the cabinet into the storage chamber and an air flow path;

a cooler configured to cool the storage chamber, the cooler being provided in the air flow path;

a heater configured to heat the storage chamber;

a circulation flow path formed in the inner guide, the circulation flow path being partitioned from the air flow path;

a first fan configured to circulate air in the storage chamber, the first fan being disposed in the circulation flow path;

a second fan provided in the air flow path and configured to blow air in the storage chamber to the cooler;

a first outlet formed in the inner guide and through which air from the circulation flow path is discharged into the storage chamber when the first fan operates;

a second outlet formed in the inner guide and through which air from the air flow path is discharged into the storage chamber when the second fan operates; and a controller configured to operate at least one of the cooler, the heater, or the first fan to manage a temperature in the storage chamber, wherein the controller operates the first fan when operating the heater, and operates the second fan and stops the first fan when cooling the storage chamber.

2. The refrigerator of claim 1, wherein the partition wall is provided in the inner case and configured to partition an interior of the cabinet into the storage chamber in front of the partition wall and an air flow path behind the partition wall, wherein the heater is provided in at least one of an inner portion of the storage chamber or the inner case.

3. The refrigerator of claim 2, wherein the heater is provided in a side wall of the inner case facing the storage chamber.

4. The refrigerator of claim 2, further comprising:

a partition that divides the storage chamber into a first space and a second space, wherein the heater is configured to heat the first space of the storage chamber, and wherein the first fan is configured to circulate air in the first space of the storage chamber, and the second fan is configured to blow air in the first space and the second space to the cooler.

5. The refrigerator of claim 4, wherein the heater is provided in the partition.

6. The refrigerator of claim 4, wherein the circulation flow path communicates with the first space and is provided behind the partition wall, and wherein the first fan is provided in the circulation flow path to circulate air in the storage chamber.

7. The refrigerator of claim 6, further comprising:

an air purifier provided in the circulation flow path.

8. The refrigerator of claim 4, wherein the controller operates the heater and the second fan while heating the first space.

9. The refrigerator of claim 4, wherein the controller operates the cooler and the second fan while cooling the first space.

10. The refrigerator of claim 4, wherein the controller concurrently operates the heater, the first fan, the cooler, and second the fan when heating the first space and cooling the second space.

11. The refrigerator of claim 10, further comprising:

a first damper configured to open and close to adjust air flowing into the first space; and a second damper configured to open and close to adjust air flowing into the second space, wherein the controller is further configured to close the first damper and open the second damper when heating the first space and cooling the second space.

12. The refrigerator of claim 4, wherein the controller manages the first fan according to a repeated cycle in which the first fan is activated during a first portion of the cycle and the first fan is turned off during a second portion of the cycle.

13. The refrigerator of claim 4, wherein the controller is further configured to manage the first fan such that:

the first fan is activated for a first length of time when a difference between a target temperature of the first space and a target temperature of the second space is a first value, and the first fan is activated for a second length of time, that is less than the first length of time, when the difference between the target temperature of the first space and the target temperature of the second space is a second value that less than the first value.

14. The refrigerator of claim 4, wherein the controller is further configured to manage the first fan such that:

the first fan is turned off for a first length of time when a difference between a target temperature of the first space and a target temperature of the second space is a first value, and the first fan is turned off for a second length of time that is shorter than the first length of time when the difference between the target temperature of the first space and the target temperature of the second space is a second value that is less than the first value.

15. The refrigerator of claim 4, wherein the controller is further configured to manage the first fan such that:

the first fan operates to generate a first wind speed when a difference between a target temperature of the first space and a target temperature of the second space is a first value, and the first fan operates to generate a second wind speed, that is less than the first wind speed, when the difference between the target temperature of the first space and the target temperature of the second space is a second value that is less than the first value.

16. A refrigerator comprising:

a cabinet having an inner case;

a partition wall that divides an interior of the inner case into a refrigeration chamber and an air flow path;

a first fan that is spaced apart from the air flow path to circulate air in the refrigeration chamber;

a refrigeration system to cool the refrigeration chamber, the refrigeration system including a second fan that blows cooled air to the air flow path;

a heater provided at one or more of an interior of the refrigeration chamber or within the inner case to heat the refrigeration chamber;

a partition member to divide the refrigeration chamber into a first space and a second space which have different storage chamber temperatures range from each other; and a controller configured to:

operate the refrigeration system to cool the refrigeration chamber when a temperature of the refrigeration chamber is greater than a set temperature or set range of temperatures, and operate the heater when the temperature of the refrigeration chamber is less than the set temperature or the set range of temperatures, wherein at least one of the first fan or the second fan is operated when heating or cooling the refrigeration chamber, and wherein the controller lengthens the first fan on time and shortens the first fan off time as a difference between temperature of the first space and temperature of the second space is increased, or the controller lengthens the first fan on time and shortens the first fan off time as a difference between target temperature of the first space and target temperature of the second space is increased.

17. The refrigerator of claim 16, wherein the controller, after initiating operation of refrigeration system to cool the refrigeration chamber; is further configured to:

start a first timer when the temperature in the refrigeration chamber is less than a target lower limit value;

start a second timer when the temperature in the refrigeration chamber is less than a lower limit value that is less than the target lower limit value; and operate the heater to heat the chamber further based on determining that a first time value for the first timer is greater than a first threshold value or that a second time value for the second timer is greater than a second threshold value that is less than the first threshold value.

18. The refrigerator of claim 17, wherein the controller is further configured to cease operation of the refrigeration system when the refrigeration chamber is cooled such that the temperature in the refrigeration chamber is less than the target lower limit value, wherein the first timer is started after ceasing operation of the refrigeration system.

19. The refrigerator of claim 16, wherein the controller, after initiating operation of the heater to warm the refrigeration chamber, is further configured to:

start a first timer when the temperature in the refrigeration chamber is greater than a target upper limit value;

start a second timer when the temperature in the refrigeration chamber is greater than an upper limit value that is greater than the target upper limit value; and operate the cooler to cool the refrigeration system chamber further based on determining that either a first time value associated with the first timer count is greater than a first threshold value or a second time value associated with the second timer count is greater than a second threshold value that is less than the first threshold value.

20. A refrigerator comprising:

a cabinet having an inner case;

a partition wall configured to partition an interior of the cabinet into the storage chamber and an air flow path;

a first fan that is spaced apart from the air flow path to circulate air in the storage chamber;

a refrigeration system to cool the storage chamber, the refrigeration system including a second fan that blows cooled air to the air flow path;

a heater provided at one or more of an interior of the storage chamber or within the inner case to heat the storage chamber; and a controller configured to:

operate the refrigeration system and perform a cooling mode to cool the storage chamber when a temperature of the refrigeration chamber is greater than a set temperature or set range of temperatures, and operate the heater and perform a heating mode when the temperature of the refrigeration chamber is less than the set temperature or the set range of temperatures, wherein, after the end of the cooling mode, if the time for which the storage chamber temperature maintains between a target temperature lower limit value and a lower limit temperature is higher than a first set time or the time for which the storage chamber temperature maintains a temperature less than the lower limit temperature is greater than a second set time that is less than the first set time, the controller start to perform the heating mode, or wherein, after the end of the heating mode, if the time for which the storage chamber temperature maintains between an upper limit value of the target temperature and an upper limit temperature is greater than a first set time or the time for which the storage chamber temperature maintains a temperature greater than the upper limit temperature is greater than a second set time that is less than the first set time, the controller starts to perform the cooling mode.

* * * * *